US009437154B2

(12) United States Patent
Nakata et al.

(10) Patent No.: US 9,437,154 B2
(45) Date of Patent: Sep. 6, 2016

(54) DISPLAY DEVICE, AND METHOD FOR DRIVING DISPLAY DEVICE

(75) Inventors: Jun Nakata, Osaka (JP); Masaki Uehata, Osaka (JP); Kohji Saitoh, Osaka (JP); Masami Ozaki, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 194 days.

(21) Appl. No.: 14/009,962

(22) PCT Filed: Apr. 5, 2012

(86) PCT No.: PCT/JP2012/059414

§ 371 (c)(1),
(2), (4) Date: Oct. 4, 2013

(87) PCT Pub. No.: WO2012/137886

PCT Pub. Date: Oct. 11, 2012

(65) Prior Publication Data

US 2014/0028658 A1 Jan. 30, 2014

(30) Foreign Application Priority Data

Apr. 8, 2011 (JP) ..... 2011-086817

(51) Int. Cl.
*G09G 3/36* (2006.01)

(52) U.S. Cl.
CPC ..... *G09G 3/3696* (2013.01); *G09G 3/3688* (2013.01); *G09G 2330/02* (2013.01); *G09G 2330/04* (2013.01); *G09G 2330/045* (2013.01)

(58) Field of Classification Search
CPC ..... G09G 2370/08; G09G 2330/02; G09G 2330/04; G09G 2330/045; G09G 2330/025; G09G 3/3666; G09G 3/3688; G09G 3/3696; G09G 2330/12; G09G 2330/06
See application file for complete search history.

(56) References Cited

U.S. PATENT DOCUMENTS

2001/0013850 A1 8/2001 Sakaguchi et al.
2006/0071882 A1* 4/2006 Sempel ..... G09G 3/3216 345/76
2008/0259061 A1* 10/2008 Lin ..... 345/204
2010/0033472 A1* 2/2010 Choi ..... G09G 3/3688 345/213
2010/0225635 A1* 9/2010 Murahashi ..... G09G 3/006 345/213
2011/0074753 A1 3/2011 Yamamoto et al.
2011/0157128 A1* 6/2011 Koyama ..... 345/211

(Continued)

FOREIGN PATENT DOCUMENTS

JP 06-274120 A 9/1994
JP 10-268834 A 10/1998

(Continued)

OTHER PUBLICATIONS

Official Communication issued in International Patent Application No. PCT/JP2012/059414, mailed on Jun. 19, 2012.

*Primary Examiner* — Priyank Shah
(74) *Attorney, Agent, or Firm* — Keating & Bennett, LLP

(57) ABSTRACT

Provided for each data signal line drive circuit (6*a*, 6*b*, 6*c*) are: a voltage generation circuit (61*a*, 61*b*, 61*c*) that generates a drive voltage in accordance with an external voltage; and a voltage determination circuit (63*a*, 63*b*, 63*c*) which determines whether or not a voltage level of at least either the external voltage or the drive voltage falls within a range of allowable voltages, in a case where the voltage level does not fall within the range of allowable voltages, operation of the voltage generation circuits (61*a*, 61*b*, 61*c*) being stopped.

17 Claims, 18 Drawing Sheets

(56) References Cited

U.S. PATENT DOCUMENTS

2011/0234574 A1* 9/2011 Tanaka ..... G09G 3/2096 345/211
2011/0242066 A1* 10/2011 Jeon ..... G09G 3/20 345/204
2011/0273422 A1* 11/2011 Park ..... 345/211
2012/0050249 A1* 3/2012 Jin ..... G09G 3/20 345/212
2012/0056857 A1* 3/2012 Li et al. ..... 345/204
2012/0146976 A1* 6/2012 Lee ..... G09G 3/3688 345/211
2012/0242628 A1* 9/2012 Yuan ..... G09G 3/20 345/204
2012/0249454 A1* 10/2012 Teraguchi ..... G06F 3/0412 345/173
2013/0016310 A1* 1/2013 Kanemitsu ..... H05B 33/0818 349/69
2013/0147724 A1* 6/2013 Hwang ..... G06F 3/0412 345/173
2014/0078133 A1* 3/2014 Lee ..... G09G 3/2092 345/213
2014/0084792 A1* 3/2014 Oh ..... H05B 37/02 315/120
2014/0111498 A1* 4/2014 Kim ..... G09G 3/3291 345/212
2014/0118316 A1* 5/2014 Ijima ..... G09G 3/3611 345/204

FOREIGN PATENT DOCUMENTS

JP 11-305717 A 11/1999
JP 2001-174843 A 6/2001
JP 2007-218965 A 8/2007
JP 2008-107410 A 5/2008
JP 2011-071277 A 4/2011

* cited by examiner

TRUTH TABLE

| INPUT s1 | INPUT s2 | OUTPUT |
|---|---|---|
| H | H | H |
| H | L | L |
| L | H | L |
| L | L | L |

TRUTH TABLE (r1, r2, r3)

| INPUT s1 | INPUT s2 | OUTPUT |
|---|---|---|
| H | H | H |
| H | L | L |
| L | H | L |
| L | L | L |

DISPLAY DEVICE, AND METHOD FOR DRIVING DISPLAY DEVICE

TECHNICAL FIELD

The present invention relates to a display device including a plurality of data signal line drive circuits and a method for driving such a display device.

BACKGROUND ART

In recent years, thin, lightweight, and low-power-consumption display devices such as liquid crystal display devices have been actively used. These display devices have been mounted prominently in mobile phones, smartphones, or laptop personal computers. Further, it is expected that in the future, there will be rapid advancements in the development and spread of electronic paper, which is a thinner display device. Under such circumstances, the current common issue is to reduce amounts of electric power that are consumed by various display devices and costs of these display devices.

Patent Literature 1 discloses a liquid crystal display device that achieves low power consumption and low cost through a reduction in the number of inputs of an LCD driver. FIG. 17 is a diagram schematically showing a configuration of the liquid crystal display device of Patent Literature 1, and FIG. 18 is a diagram showing an internal configuration of a source driver IC 20 (data signal line drive circuit).

As shown in FIG. 17, the liquid crystal display device includes: a liquid crystal cell 2 that forms an image display region on a substrate; and a source driver 7 that applies a voltage to the liquid crystal cell 2 in accordance with a video signal inputted via a video I/F 3. The source driver 7 includes a plurality of source driver ICs 20 mounted on the same substrate as the liquid crystal cell 2 and cascade-connected via signal lines.

CITATION LIST

Patent Literature 1

Japanese Patent Application Publication, Tokukai, No. 2001-174843 A (Publication Date: Jun. 29, 2001)

SUMMARY OF INVENTION

Technical Problem

However, in the case of an abnormality in an input voltage that is inputted to a data signal line drive circuit (source driver IC 20 of FIG. 18) or in a drive voltage that is needed for a data signal line drive circuit to be driven, the technology described in Patent Literature 1 has such a problem that while the data signal line drive circuit suffering from the abnormality stops operating, the other data signal line drive circuit continues to be supplied with voltages and therefore do not stop operating. Possible examples of such an abnormality in input voltage or in drive voltage include: a reduction in input voltage in the case of battery driving; and a reduction or rise in input voltage or in drive voltage due to passage of a large electric current in the case of a short in each drive circuit and in an internal circuit of a display panel. Such an abnormality causes an overcurrent to pass through the data signal line drive circuits that keep operating, so that there occur serious problems such heating, fuming, and ignition.

The present invention has been made in view of the foregoing problems, and it is an object of the present invention to provide: a display device including a plurality of data signal line drive circuits all of which can be safely stopped in the case of an abnormality in an input voltage that is inputted to a data signal line drive circuit or in a drive voltage that is needed for a data signal line drive circuit to be driven; and a method for driving such a display device.

Solution to Problem

In order to solve the foregoing problems, a display device according to the present invention is a display device including a plurality of data signal line drive circuits, including: voltage generating means, provided for each of the plurality of data signal line drive circuit, for generating, in accordance with an external voltage inputted from an outside source, a drive voltage that is needed for the data signal line drive circuit to be driven; and voltage determining means, provided for each of the plurality of data signal line drive circuit, for determining whether or not a voltage level of at least either the external voltage or the drive voltage falls within a predetermined range of allowable voltages, in a case where it has been determined, in at least one of the plurality of voltage determining means, that the voltage level does not fall within the range of allowable voltages, operation of the voltage generating means corresponding to all of the data signal line drive circuits being stopped.

It should be noted here that the voltage determining means may be configured (1) to include both a determination circuit that detects (determines) a reduction or rise in the external voltage and a determination circuit that detects (determines) a reduction or rise in the drive voltage and detect (determine) an abnormality in either the external voltage or the drive voltage or abnormalities in both the external voltage and the drive voltage, (2) to include only a determination circuit that detects (determines) a reduction or rise in the external voltage and detect (determine) an abnormality in the external voltage, or (3) to include only a determination circuit that detects (determines) a reduction or rise in the drive voltage and detect (determine) an abnormality in the drive voltage.

With the foregoing configuration, the operation of the voltage generating means in all of the data signal line drive circuits is stopped in the case of an abnormality (voltage reduction or voltage rise) in either the external voltage or the drive voltage in a data signal line drive circuit. That is, all of the data signal line drive circuits can be safely stopped. This prevents the external voltage A from continuing to be supplied to a normal data signal line drive circuit and the drive voltage from continuing to be generated as has conventionally been the case, thereby preventing problems such as heating and fuming.

In order to solve the foregoing problems, a method for driving a display device according to the present invention is a method for driving a display device including a plurality of data signal line drive circuits, including: a voltage generating step of, for each of the plurality of data signal line drive circuits, generating, in accordance with an external voltage inputted from an outside source, a drive voltage that is needed for that data signal line drive circuit to be driven; and a voltage determining step of, for each of the plurality of data signal line drive circuits, determining whether or not a voltage level of at least either the external voltage or the drive voltage falls within a predetermined range of allowable voltages, in a case where it has been determined, in at least one of the plurality of data signal line drive circuits, that the voltage level does not fall within the range of allowable voltages, operation of the voltage generating step in all of the data signal line drive circuits being stopped.

The foregoing method brings about effects that are brought about by the configuration of the foregoing display device.

Advantageous Effects of Invention

As described above, the display device according to the present invention is configured such that in a case where it has been determined, in at least one of the plurality of voltage determining means, that the voltage level does not fall within the range of allowable voltages, operation of the voltage generating means corresponding to all of the data signal line drive circuits is stopped.

Further, the method for driving a display device according to the present invention is arranged such that in a case where it has been determined, in at least one of the plurality of data signal line drive circuits, that the voltage level does not fall within the range of allowable voltages, operation of the voltage generating step in all of the data signal line drive circuits is stopped.

This makes it possible to safely stop all of the data signal line drive circuits in the case of an abnormality in an external voltage that is inputted to a data signal line drive circuit or in a drive voltage that is needed for a data signal line drive circuit to be driven.

DESCRIPTION OF EMBODIMENTS

Schematically, a display device of the present invention includes a plurality of data signal line drive circuits, and is configured such that the operation of voltage generation circuits in all of the data signal line drive circuits is stopped, for example, in a case where the voltage level of at least either an external voltage inputted from an outside source to a data signal line drive circuit or a drive voltage generated for driving the data signal line drive circuit no longer falls within a predetermined range of allowable voltages.

Embodiments of display devices thus configured are described below with reference to the drawings.

Embodiment 1

Configuration of a Display Device 1

Figure 2:
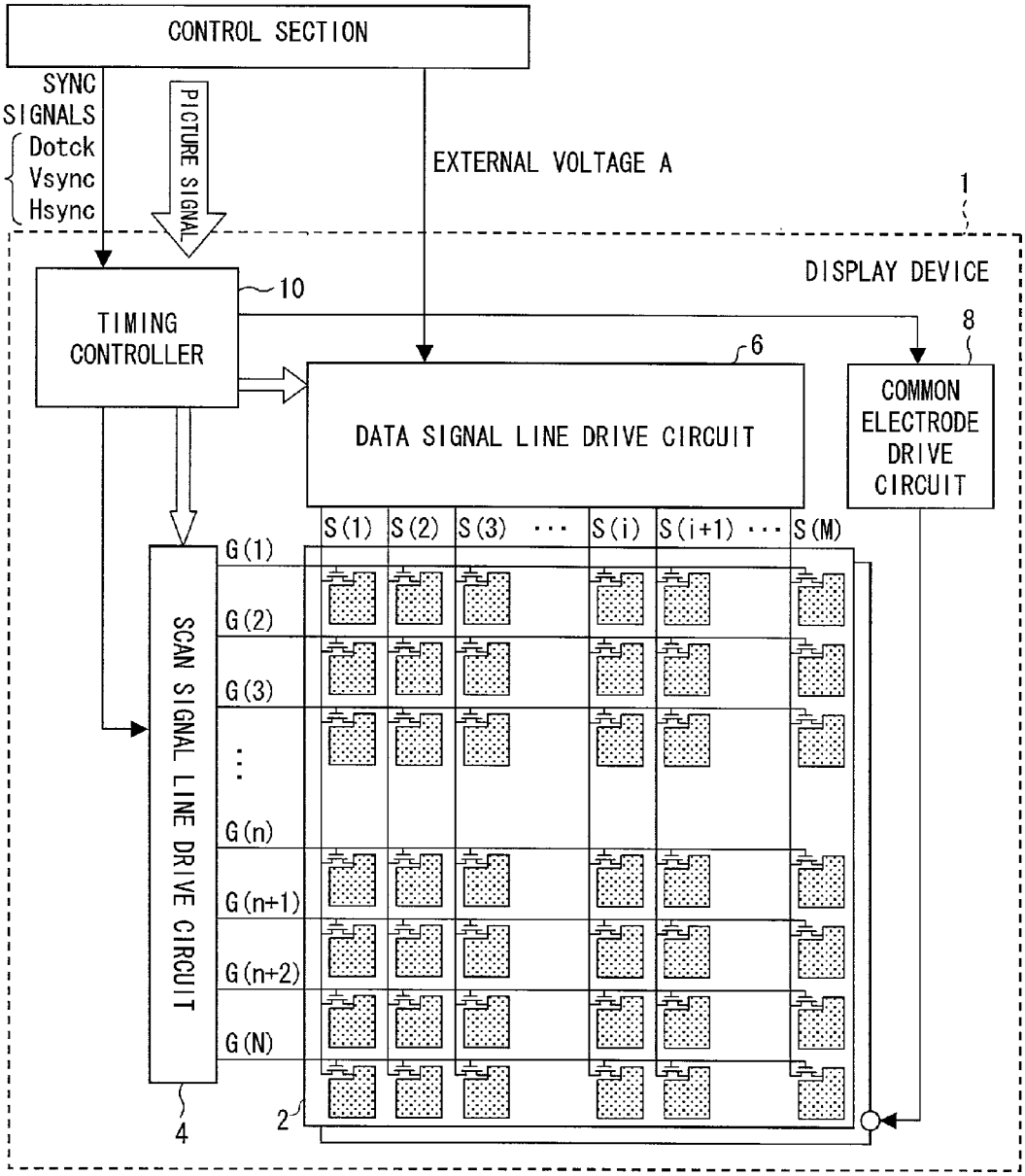
FIG. 2 is a diagram showing an overall structure of the display device according to Embodiment 1.

First, a configuration of a display device (liquid crystal display device) 1 according to Embodiment 1 is described with reference to FIG. 2. FIG. 2 is a diagram showing an overall structure of the display device 1. As shown in FIG. 2, the display device 1 includes a display panel 2, a scan signal line drive circuit (gate driver) 4, a data signal line drive circuit 6 (source driver) 6, a common electrode drive circuit 8, and a timing controller 10.

The display panel 2 includes: a screen composed of a plurality of pixels arranged in an matrix manner; N (where N is a given integer) scan signal lines G (gate lines) that are selected line-sequentially so that the screen is scanned; and M (where M is a given integer) data signal lines S (source lines via each of which a data signal is supplied to a single row of pixels included in a selected one of the gate lines. The scan signal lines G and the data signal lines S intersect at right angles to each other. Provided at each of the intersections between the scan signal lines G and the data signal lines S is a transistor (thin-film transistor, TFT) having its gate electrode connected to its corresponding one of the scan signal lines G, its source electrode connected to its corresponding one of the data signal lines S, and its drain electrode connected to a pixel electrode.

In FIG. 2, the sign "G(n)" denotes the nth (where n is a given integer) scan signal line G. For example, the signs "G(1)", "G(2)", and "G(3)" denote the first, second, and third scan signal lines G, respectively. Meanwhile, the sign "S(i)" denotes the ith (where i is a given integer) data signal line S. For example, the signs "S(1)", "S(2)", and "S(3)" denote the first, second, and third data signal lines S, respectively.

The scan signal line drive circuit 4 scans the scan signal lines G line-sequentially from top to bottom of the screen. In so doing, the scan line drive circuit 4 outputs, to each of the scan signal lines G, a rectangular wave for turning on the transistors provided in the pixels and connected to the pixel electrodes. This brings a single row of pixels in the screen into a selected state.

The timing controller 10 receives sync signals (a clock signal Dotclk, a vertical sync signal Vsync, and a horizontal sync signal Hsyn) from an external control section, generates, in accordance with these sync signals, signals on the basis of which the circuits operate in sync with one another, and outputs the signals thus generated to the circuits. Specifically, the timing controller 10 outputs a gate start pulse signal and a gate clock signal to the scan signal line drive circuit 4, and outputs a source start pulse signal, a source latch strobe signal, and a source clock signal to the data signal line drive circuit 6. Further, the timing controller 10 receives, from the external control section, a digital video signal (picture signal) representing an image to be displayed, generates a digital image signal as a signal that causes a display section to display the image represented by the picture signal, and outputs the digital image signal to the data signal line drive circuit 6.

The data signal line drive circuit 6 computes, from the digital image signal inputted thereto, the values of voltages to be outputted to a single row of pixels selected and outputs voltages (image data) of these values to the data signal lines S, respectively. This causes the image data to be supplied to the pixels on a selected one of the scan signal lines G.

The display device 1 includes a common electrode (not illustrated) provided to each pixel in the screen. The common electrode drive circuit 8 receives a signal from the timing controller 10, generates, in accordance with the signal, a predetermined common voltage for driving the common electrode, and outputs the predetermined common voltage to the common electrode.

Upon receiving the gate start pulse signal from the timing controller 10, the scan signal line drive circuit 4 starts scanning the display panel 2 and applies selection voltages to the scan signal lines G in sequence in accordance with the gate clock signal. Upon receiving the source start pulse signal from the timing controller 10, the data signal line drive circuit 6 stores the image data in a register for each pixel in accordance with the source clock signal and writes the image data to the data signal lines S of the display panel 2 in accordance with the source latch strobe signal that follows.

The external control section is provided with a power supply section (not illustrated) from which voltages that are need for the circuits in the display device 1 to operate are supplied. That is, the display device 1 is supplied with a so-called analog power-supply voltage (hereinafter referred to as "external voltage A") and a so-called logic power-supply voltage (hereinafter referred to as "external voltage B") from the power supply section. A external voltage A serves as a source of generation of a power-supply voltage that is needed in the data signal line drive circuit, and an external voltage B is used for processing in a control circuit in the data signal line drive circuit. It should be noted, however, that an external voltage B may be generated in the display device in accordance with an external voltage A supplied from the control section. Therefore, for convenience of explanation, FIG. 2 shows an external voltage A that is supplied to the data signal line drive circuit 6, but does not show an external voltage B.

(Configuration of the Data Signal Line Drive Circuit 6)

Figure 1:
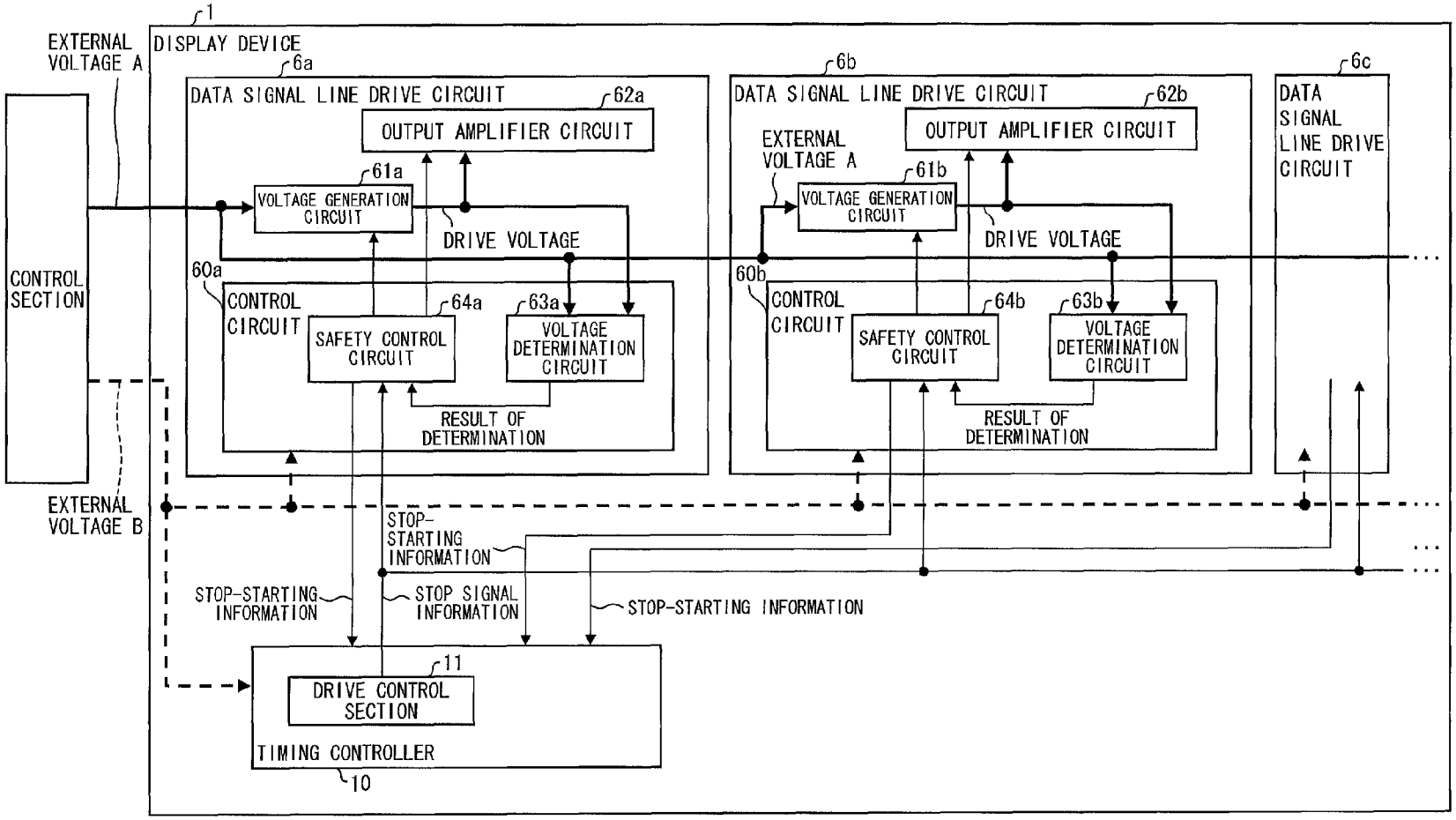
FIG. 1 is a diagram specifically showing a configuration of data signal line drive circuits in a display device according to Embodiment 1.

FIG. 1 is a block diagram specifically showing a configuration of the data signal line drive circuit 6. A configuration of the data signal line drive circuit 6 is described in detail below with reference to FIG. 1.

The data signal line drive circuit 6 includes a plurality of data signal line drive circuits 6*a*, 6*b*, 6*c*, . . . , and each of the data signal line drive circuits 6*a*, 6*b*, 6*c*, . . . are provided for a plurality of data signal lines. For example, in a case where the display device 1 is provided with three data signal line drive circuits 6*a*, 6*b*, and 6*c*, M/3 out of the M data signal lines are connected to each of the data signal line drive circuits 6*a*, 6*b*, and 6*c*. Each of the data signal line drive circuits 6*a*, 6*b*, and 6*c* can be driven separately.

A case is described here where the display device 1 is provided with three data signal line drive circuits 6*a*, 6*b*, and 6*c*. Further, since the data signal line drive circuits 6*a*, 6*b*, and 6*c* are identical in configuration to one another, the case is described by taking the data signal line drive circuit 6*a* as a main example.

As shown in FIG. 1, the data signal line drive circuit 6*a* includes a voltage generation circuit (power supply generation circuit, voltage generating means) 61*a*, an output amplifier circuit 62*a*, and a control circuit 60*a*, and the control circuit 60*a* includes a voltage determination circuit (voltage determining means) 63*a* and a safety control circuit (safety control means) 64*a*.

The voltage generation circuit 61*a* receives an external voltage A inputted from the power supply section of the external control section and generates, in accordance with the external voltage A, a voltage (drive voltage) that is necessary for the output amplifier circuit 62*a*. For example, the voltage generation circuit 61*a* receives an external voltage A of 3.3 V and generates a drive voltage of 5.0 V. The drive voltage thus generated is inputted to the output amplifier circuit 62*a* and the voltage determination circuit 63*a*. It should be noted that among drive voltages that are generated in the voltage generation circuit 61*a* are gate voltages (Vgh, Vgl) that are used in the scan signal line drive circuit 4.

The output amplifier circuit 62*a* includes a plurality of analog amplifier blocks (not illustrated) each of which is connected to a data signal line S and supplies a data signal to that data signal line S.

The voltage determination circuit 63*a* receives the external voltage A inputted from the power supply section of the external control section and the drive voltage generated in the voltage generation circuit 61*a*. Then, the voltage determination circuit 63*a* performs a process (first determination process) of determining, by comparing the external voltage A with a predetermined first range of allowable voltages, whether or not the external voltage A falls within the first range of allowable voltages. Further, the voltage determination circuit 63*a* performs a process (second determination process) of determining, by comparing the drive voltage with a predetermined second range of allowable voltages, whether or not the drive voltage falls within the second range of allowable voltages.

The voltage determination circuit 63*a* includes a first determination circuit h1 (see FIGS. 3 and 4, which will be described later) that performs the first determination process and a second determination circuit h2 (see FIGS. 3 and 4, which will be described later) that performs the second determination process. It should be noted that the voltage determination circuit 63*a* of the display device 1 needs only perform at least either the first or second determination process, and as such, can be configured:

(1) to include both the first determination circuit h1 and the second determination circuit h2 when configured to detect (determine) an abnormality in either the external voltage A or the drive voltage or abnormalities in both the external voltage A and the drive voltage;

(2) to include only the first determination circuit h1 when configured to detect (determine) an abnormality in the external voltage A alone; or (3) to include only the second determination circuit h2 when configured to detect (determine) an abnormality in the drive voltage alone.

The following explains the aforementioned case (1), where the voltage determination circuit 63*a* is configured to include both the first determination circuit h1 and the second determination circuit h2 and detect (determine) an abnormality in either the external voltage A or the drive voltage or abnormalities in both the external voltage A and the drive voltage.

The display device 1 thus configured makes it possible to detect an abnormality in power-supply voltage in the data signal line drive circuit 6*a*. The voltage determination circuit 63*a* will be described in detail later. It should be noted that the first range of allowable voltages and the second range of allowable voltages each separately have its lower and upper limits (low-limit and upper-limit voltage levels) set. That is, the external voltage A is determined as normal when its voltage level falls within a range from a first lower limit to a first upper limit (first range of allowable voltages), and is determined as abnormal when its voltage level is out of the first range of allowable voltages. Further, the drive voltage is determined as normal when its voltage level falls within a range from a second lower limit to a second upper limit (second range of allowable voltages), and is determined as abnormal when its voltage level is out of the second range of allowable voltages.

Possible examples of abnormalities in power-supply voltage here include: an abnormality due a reduction in the external voltage A in the case of battery driving; an abnormality due to a reduction or rise in the external voltage A or in the drive voltage due to passage of a large electric current in the case of a short in each drive circuit and in an internal circuit of the display panel; etc.

Upon detecting such an abnormality in power-supply voltage, i.e., in a case where at least either the external voltage A or the drive voltage no longer falls within its corresponding range of allowable voltage (first range of allowable voltages, second range of allowable voltages), the voltage determination circuit 63*a* transmits a result of determination to that effect to the safety control circuit 64*a*.

The safety control circuit 64*a* performs a process of controlling how the voltage generation circuit 61*a* and the output amplifier circuit 62*a* are driven. Upon receiving the result of determination from the voltage determination circuit 63*a*, the safety control circuit 64*a* outputs, to the voltage generation circuit 61*a* and the output amplifier circuit 62*a*, stop signal information corresponding to a drive-stopping command. Upon receiving the stop signal information, the voltage generation circuit 61*a* stops the operation of generating a drive voltage and the operation of outputting the drive voltage thus generated. Upon receiving the stop signal information, the output amplifier circuit 62*a* stops the operation of outputting a data signal to a data signal line S.

Further, upon receiving the result of determination from the voltage determination circuit 63*a*, the safety control circuit 64*a* further transmits, to the timing controller 10, stop-starting information for starting a stopping process of stopping the operation of the voltage generation circuits 61*b* and 61*c* and the output amplifier circuits 62*b* and 62*c* in the data signal line drive circuits 6*b* and 6*c*.

The timing controller 10 includes a drive control section 11 that controls the operation of each of the data signal line drive circuits 6*a*, 6*b*, and 6*c*. Upon receiving the stop-starting information from the safety control circuit 64*a*, the drive control section 11 outputs stop signal information for stopping the operation of the voltage generation circuits 61*b* and 61*c* and the output amplifier circuits 62*b* and 62*c* in the data signal line drive circuits 6*b* and 6*c*.

Upon receiving the stop signal information from the drive control section 11, the safety control circuit 64*b* of the data signal line drive circuit 6*b* outputs the stop signal information to the voltage generation circuit 61*b* and to the output amplifier circuit 62*b*. Upon receiving the stop signal information, the voltage generation circuit 61*b* stops the operation of generating a drive voltage and the operation of outputting the drive voltage thus generated. Upon receiving the stop signal information, the output amplifier circuit 62*b* stops the operation of outputting a data signal to a data signal line S.

Similarly, upon receiving the stop signal information from the drive control section 11, the safety control circuit 64*c* of the data signal line drive circuit 6*c* outputs the stop signal information to the voltage generation circuit 61*c* and to the output amplifier circuit 62*c*. Upon receiving the stop signal information, the voltage generation circuit 61*c* stops the operation of generating a drive voltage and the operation of outputting the drive voltage thus generated. Upon receiving the stop signal information, the output amplifier circuit 62*c* stops the operation of outputting a data signal to a data signal line S.

With this configuration of the display device 1, the operation of the voltage generation circuits and the output amplifier circuits in all of the data signal line drive circuits is stopped in the case of an abnormality (voltage reduction or voltage rise) in either the external voltage A or the drive voltage in a data signal line drive circuit. This prevents the external voltage A from continuing to be supplied to a normal data signal line drive circuit and the drive voltage from continuing to be generated as has conventionally been the case, thereby preventing problems such as heating and fuming.

It should be noted that the display device 1 may be configured such that the operation of only the voltage generation circuits is stopped in the case of such an abnormality in voltage. This makes it possible to stop the operation of the data signal line drive circuits by stopping the operation of at least the voltage generation circuits, and to simplify the circuit configuration.

In stopping both the voltage generation circuits and the output amplifier circuits, it is preferable, for the sake of safety, to stop the output amplifier circuits first and then stop the voltage generation circuits.

Further, instead of being limited to being configured, as described above, such that each of the voltage generation circuits provided in the respective data signal line drive circuits and each of the voltage determination circuits provided in the respective data signal line drive circuits perform a voltage generation process and a voltage determination process separately, the display device 1 may alternatively be configured such that at least two of all of the voltage generation circuits perform the voltage generation process and at least two of all of the voltage determination circuits perform the voltage determination process. That is, there may be a data signal line drive circuit configured not to perform the voltage generation process or the voltage determination process. This makes it possible to achieve lower power consumption.

(Configuration of the Control Circuit)

A configuration of the control circuit 60*a* is specifically described with reference to FIGS. 1 and 3 by taking the data signal line drive circuit 6*a* as an example. For convenience of explanation, the control circuit 60*a* is described below by taking, as an example, a case where the voltage level of at least either the external voltage A or the drive voltage falls below the lower limit (first lower limit, second lower limit) of its corresponding range of allowable voltages (first range of allowable voltages, second range of allowable voltages).

Figure 3:
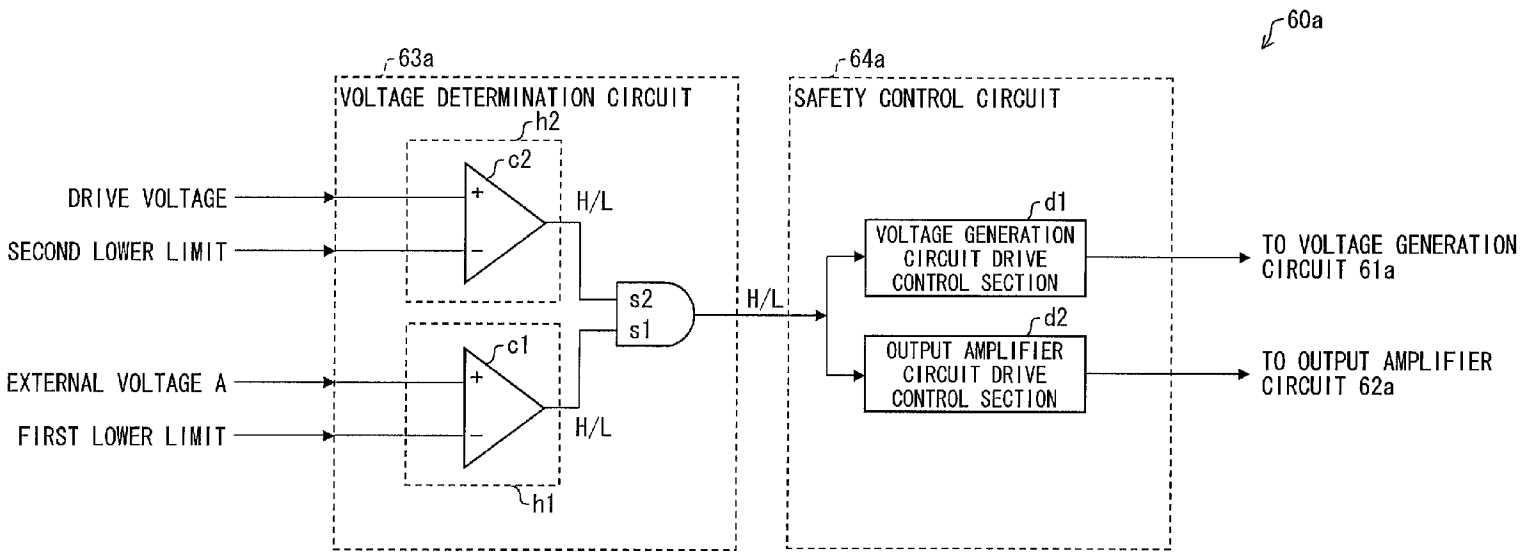
FIG. 3 is a diagram specifically showing a configuration of a control circuit in the display device according to Embodiment 1.

FIG. 3 is a diagram specifically showing a configuration of the control circuit 60*a*. As described above, the control circuit 60*a* includes the voltage determination circuit 63*a* and the safety control circuit 64*a*.

The voltage determination circuit 63*a* includes: the first determination circuit h1, which is composed of a first comparison circuit c1; the second determination circuit h2, which is composed of a second comparison circuit c2; and a logic circuit (AND circuit). The first comparison circuit c1 has a terminal to which the external voltage A is inputted and a terminal to which the first lower limit is inputted, and the second comparison circuit c2 has a terminal to which the drive voltage is inputted and a terminal to which the second lower limit is inputted. The first comparison circuit c1 and the second comparison circuit c2 have their outputs inputted to input terminals s1 and s2 of the AND circuit, respectively.

The first comparison circuit c1 outputs a High-level signal (H level; "1") in a case where the external voltage A exceeds the first lower limit, and outputs a Low-level signal (L level; "0") in a case where the external voltage A falls below the first lower limit. It should be noted that the first comparison circuit c1 may be configured to output a L level ("0") in a case where the external voltage A continues to be below the first lower limit for a predetermined period of time.

The second comparison circuit c2 outputs a High-level signal (H level; "1") in a case where the drive voltage exceeds the second lower limit, and outputs a Low-level signal (L level; "0") in a case where the drive voltage falls below the second lower limit. It should be noted that the second comparison circuit c2 may be configured to output a L level ("0") in a case where the drive voltage continues to be below the second lower limit for a predetermined period of time.

Since the first comparison circuit c1 and the second comparison circuit c2 have their outputs inputted to the input terminals s1 and s2 of the AND circuit, respectively, the AND circuit has its output at a H level ("1") in a case where both the external voltage A and the drive voltage exceed their corresponding lower limits (i.e., in a case where H levels ("1") are outputted) and the AND circuit has its output at a L level ("0") in a case where at least either the external voltage A or the drive voltage falls below its corresponding lower limit (i.e., in a case where a H level ("0") is outputted), as shown in a truth table of FIG. 3. That is, the voltage determination circuit 63*a* outputs a H level ("1") to the safety control circuit 64*a* in a case where both the external voltage A and the drive voltage exceed their corresponding lower limits, and outputs a L level ("0") to the safety control circuit 64*a* in a case where at least either the external voltage A or the drive voltage falls below its corresponding lower limit.

As just described, the voltage determination circuit 63*a* determines whether or not the voltage level of at least either the external voltage A or the drive voltage falls below a preset lower limit, and outputs a result of the determination (H level ("1") or L level ("0")).

Figure 4:
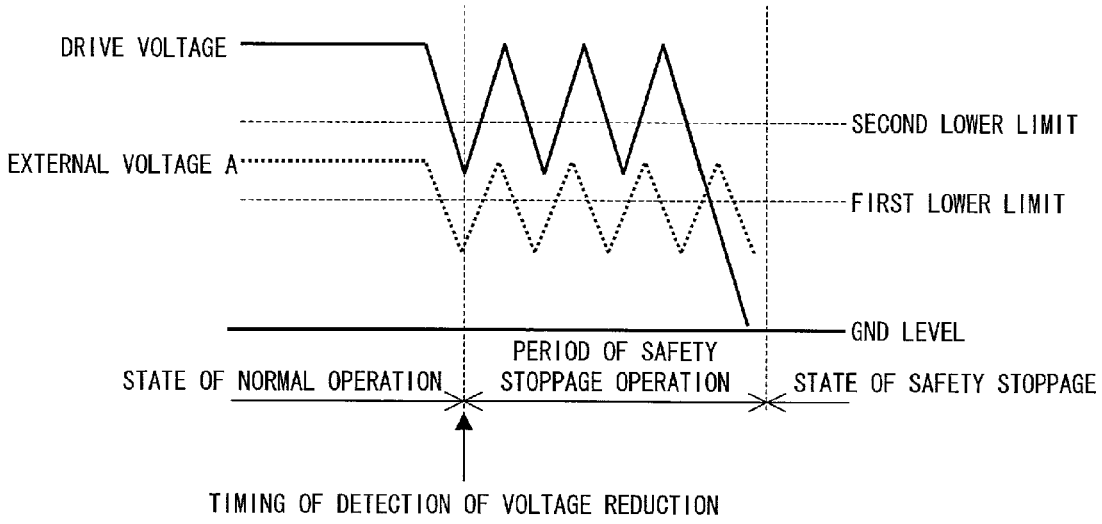
FIG. 4 is a graph showing an example of a relationship between an external voltage A and a first lower limit and an example of a relationship between a drive voltage and a second lower limit.

FIG. 4 is a graph showing a relationship between the external voltage A and the first lower limit and a relationship between the drive voltage and the second lower limit. As shown in FIG. 4, the first lower limit and the second lower limit are each set separately in relation to the external voltage A and the drive voltage, respectively. Normally, since a relationship "external voltage A<drive voltage" holds, the first lower limit and the second lower limit are set so that a relationship "first lower limit<second lower limit" holds. In FIG. 4, the external voltage A is below the first lower limit, and the drive voltage is below the second lower limit.

As shown in FIG. 3, the safety control circuit 64*a* includes a voltage generation circuit drive control section d1 and an output amplifier circuit drive control section d2. Upon receiving a L-level ("0") output signal (result of determination) from the voltage determination circuit 63*a*, the voltage generation circuit drive control section d1 causes the voltage generation circuit 61*a* to stop the operation of generating a drive voltage and the operation of outputting the drive voltage thus generated. Further, upon receiving a L-level ("0") output signal (result of determination) from the voltage determination circuit 63*a*, the output amplifier circuit drive control section d2 causes the output amplifier circuit 62*a* to stop the operation of outputting a data signal to a data signal line S. This makes it possible to safely stop the voltage generation circuit 61*a* and the output amplifier circuit 62*a* in the case of an abnormality (voltage reduction or voltage rise) in at least either the external voltage A or the drive voltage.

Furthermore, as shown in FIG. 1, the safety control circuit 64*a* transmits, to the timing controller 10, stop-starting information for starting the stopping process of stopping the operation of the voltage generation circuits 61*b* and 61*c* and the output amplifier circuits 62*b* and 62*c* in the data signal line drive circuits 6*b* and 6*c*. As soon as the timing controller 10 receives the stop-starting information from the safety control circuit 64*a*, the drive control section 11 outputs, to the safety control circuits 64*b* and 64*c* in the data signal line drive circuits 6*b* and 6*c*, stop signal information for stopping the operation of the voltage generation circuits 61*b* and 61*c* and the output amplifier circuits 62*b* and 62*c*.

As soon as the safety control circuit 64*b* of the data signal line drive circuit 6*b* receives the stop signal information from the drive control section 11 of the timing controller 10, the voltage generation circuit drive control section d1 (not illustrated) in the safety control circuit 64*b* causes the voltage generation circuit 61*b* to stop the operation of generating a drive voltage and the operation of outputting the drive voltage thus generated, and the output amplifier circuit drive control section d2 (not illustrated) in the safety control circuit 64*b* causes the output amplifier circuit 62*b* to stop the operation of outputting a data signal to a data signal line S.

Similarly, as soon as the safety control circuit 64*c* of the data signal line drive circuit 6*c* receives the stop signal information from the drive control section 11 of the timing controller 10, the voltage generation circuit drive control section d1 (not illustrated) in the safety control circuit 64*c* causes the voltage generation circuit 61*c* to stop the operation of generating a drive voltage and the operation of outputting the drive voltage thus generated, and the output amplifier circuit drive control section d2 (not illustrated) in the safety control circuit 64*c* causes the output amplifier circuit 62*c* to stop the operation of outputting a data signal to a data signal line S.

It should be noted that the drive control section 11 of the timing controller 10 may be configured to also output the stop signal information to the safety control circuit 64*a* of the data signal line drive circuit 6*a*. By performing the drive-stopping operation based on the stop signal information from the timing controller 10 in addition to the drive-stopping operation based on a result of determination from the voltage determination circuit 63*a*, the safety control circuit 64*a* can surely execute the stopping process.

This configuration makes it possible, in a case where the voltage level of at least either the external voltage A or the drive voltage in a data signal line drive circuit falls below its corresponding lower limit (first lower limit, second lower limit), to stop the operation of the voltage generation circuits and the output amplifier circuits in the other data signal line drive circuits.

It should be noted here that by causing the "first lower limit" and the "second lower limit" of FIG. 3 to serve as the "first upper limit" and the "second upper limit", respectively, an operation can be achieved which is performed in a case where the voltage level of at least either the external voltage A or the drive voltage exceeds the upper limit (first upper limit, second upper limit) of its corresponding range of allowable voltages (first range of allowable voltages, second range of allowable voltages). In this case, the first upper limit and the second upper limit are each set separately in relation to the external voltage A and the drive voltage, respectively. Normally, since a relationship "external voltage A<drive voltage" holds, the first upper limit and the second upper limit are set so that a relationship "first upper limit<second upper limit" holds. This makes it possible, in a case where the voltage level of at least either the external voltage A or the drive voltage in a data signal line drive circuit exceeds its corresponding upper limit (first upper limit, second upper limit), to stop the operation of the voltage generation circuits and the output amplifier circuits in the other data signal line drive circuits. The configuration in which the "first lower limit" and the "second lower limit" serve as the "first upper limit" and the "second upper limit", respectively, can also be applied to each of those voltage determination circuits 63*a*, which will be described later.

Figure 5:
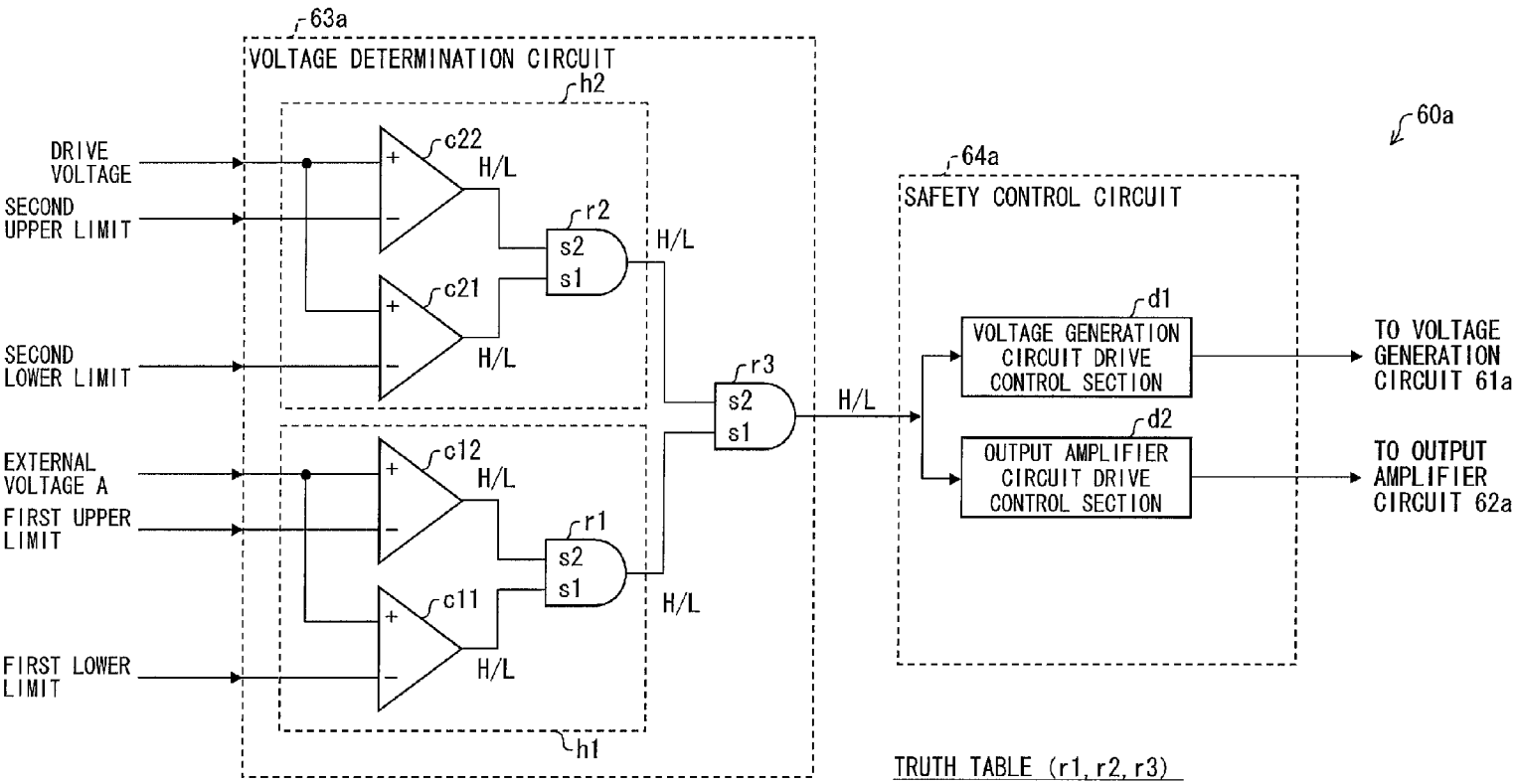
FIG. 5 is a diagram specifically showing a configuration of a control circuit in the display device according to Embodiment 1.

Alternatively, a configuration in which it is determined whether or not the voltage level of at least either the external voltage A or the drive voltage falls within its corresponding range of allowable voltages (first range of allowable voltages, second range of allowable voltages) can be achieved by configuring the control circuit 60*a* as shown, for example, in FIG. 5.

The voltage determination circuit 63*a* of FIG. 5 includes: a first determination circuit h1 composed of a first lower-limit comparison circuit c11 and a first upper-limit comparison circuit c12; a second determination circuit h2 composed of a second lower-limit comparison circuit c21 and a second upper-limit comparison circuit c22; a first logic circuit (first AND circuit) r1; a second logic circuit (second AND circuit) r2; and a third logic circuit (third AND circuit) r3.

The first lower-limit comparison circuit c11 has a terminal to which the external voltage A is inputted and a terminal to which the first lower limit is inputted, and the first upper-limit comparison circuit c12 has a terminal to which the external voltage A is inputted and a terminal to which the first upper limit is inputted. The second lower-limit comparison circuit c21 has a terminal to which the drive voltage is inputted and a terminal to which the second lower limit is inputted, and the second upper-limit comparison circuit c22 has a terminal to which the drive voltage is inputted and a terminal to which the second upper limit is inputted. The first lower-limit comparison circuit c11 and the first upper-limit comparison circuit c12 have their outputs inputted to input terminals s1 and s2 of the first AND circuit r1, respectively, and the second lower-limit comparison circuit c21 and the second upper-limit comparison circuit c22 have their outputs inputted to input terminals s1 and s2 of the second AND circuit r2, respectively. The first AND circuit r1 and the second AND circuit r2 have their outputs inputted to input terminals s1 and s2 of the third AND circuit r3, and the third AND circuit r3 has its output inputted to the safety control circuit 64*a*.

The first lower-limit comparison circuit c11 outputs a High-level signal (H level; "1") in a case (normal) where the external voltage A exceeds the first lower limit, and outputs a Low-level signal (L level; "0") in a case (abnormal) where the external voltage A falls below the first lower limit; the first upper-limit comparison circuit c12 outputs a High-level signal (H level; "1") in a case (normal) where the external voltage A falls below the first upper limit, and outputs a Low-level signal (L level; "0") in a case (abnormal) where the external voltage A exceeds the first upper limit. Similarly, the second lower-limit comparison circuit c21 outputs a High-level signal (H level; "1") in a case (normal) where the drive voltage exceeds the second lower limit, and outputs a Low-level signal (L level; "0") in a case (abnormal) where the drive voltage falls below the second lower limit; the second upper-limit comparison circuit c22 outputs a High-level signal (H level; "1") in a case (normal) where the drive voltage falls below the second upper limit, and outputs a Low-level signal (L level; "0") in a case (abnormal) where the drive voltage exceeds the second upper limit.

The configuration of FIG. 5 makes it possible, in a case where the voltage level of at least either the external voltage A or the drive voltage in a data signal line drive circuit no longer falls within its corresponding range of allowable voltages (first range of allowable voltages, second range of allowable voltages), to stop the operation of the voltage generation circuits and the output amplifier circuits in the other data signal line drive circuits. It goes without saying that the control circuit 60*a* for achieving this configuration is not limited to the configuration of FIG. 5. Further, as mentioned above, the voltage determination circuit 63*a* can be configured to include only the first determination circuit h1 (FIG. 5) when configured to detect (determine) an abnormality in the external voltage A alone or to include only the second determination circuit h2 (FIG. 5) when configured to detect (determine) an abnormality in the drive voltage alone.

The following describes modifications of the display device 1. It should be noted that the following describes points of difference from the display device 1 shown in FIG. 1, and omits to describe components that are identical to those of the display device 1 shown in FIG. 1.

(Modification 1)

Figure 6:
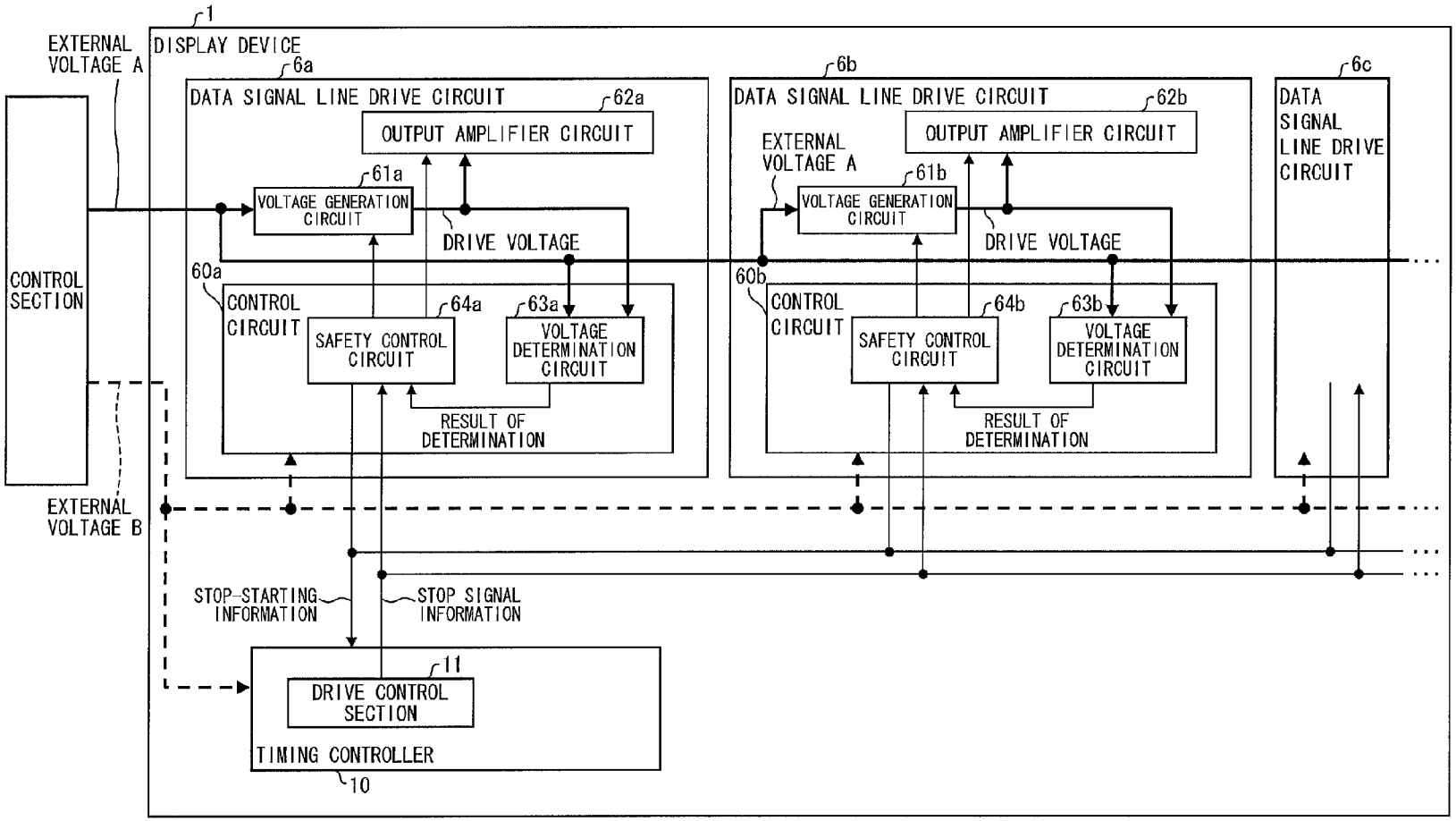
FIG. 6 is a diagram showing a configuration of a display device according to Modification 1 of Embodiment 1.

FIG. 6 is a diagram showing a configuration of a display device 1 according to Modification 1. In the display device 1 of FIG. 1, the safety control circuits 64*a*, 64*b*, and 64*c* are connected to the timing controller 10 via separate signal lines. In the display device 1 according to Modification 1, as shown in FIG. 6, the safety control circuits 64*a*, 64*b*, and 64*c* are connected to one another and connected to the timing controller 10 via a common signal line. This makes it possible to reduce the number of signal lines, thus making it possible to reduce the number of terminals, size, and cost of the timing controller 10.

(Modification 2)

Figure 7:
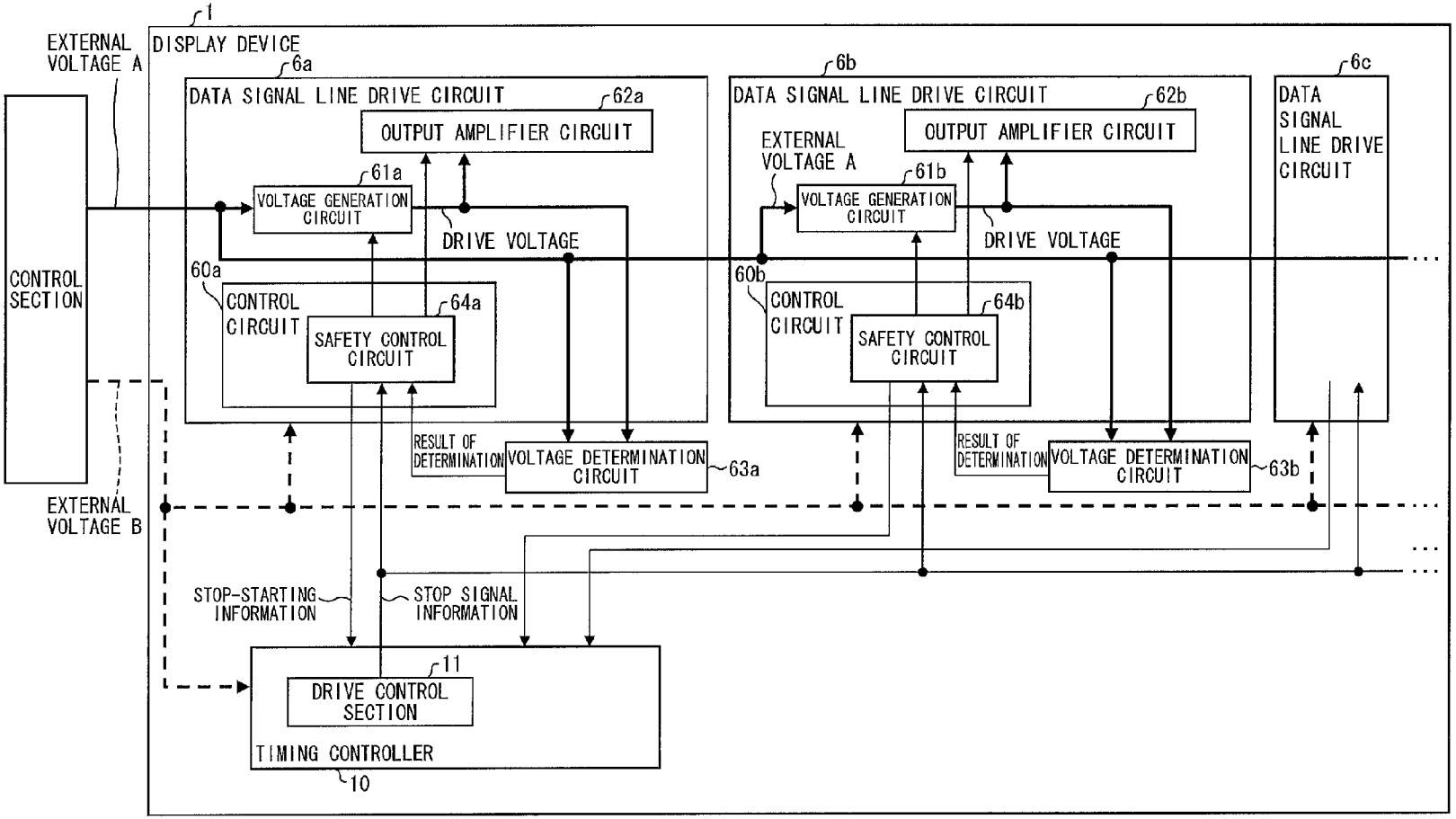
FIG. 7 is a diagram showing a configuration of a display device according to Modification 2 of Embodiment 1.

FIG. 7 is a diagram showing a configuration of a display device 1 according to Modification 2. In the display device 1 of FIG. 1, the voltage determination circuits 63*a*, 63*b*, and 63*c* are provided inside of the control circuits 60*a*, 60*b*, and 60*c* in the data signal line drive circuits 6*a*, 6*b*, and 6*c*, respectively. In the display device 1 according to Modification 2, as shown in FIG. 7, the voltage determination circuits 63*a*, 63*b*, and 63*c* are provided outside of the data signal line drive circuits 6*a*, 6*b*, and 6*c*, respectively. This makes it possible to reduce the data signal line drive circuits 6*a*, 6*b*, and 6*c* in size.

Alternatively, the display device 1 according to Modification 2 may be configured such that the voltage determination circuits 63*a*, 63*b*, and 63*c* are provided inside of the control circuits 60*a*, 60*b*, and 60*c* in the data signal line drive circuits 6*a*, 6*b*, and 6*c*, respectively, and the safety control circuits 64*a*, 64*b*, and 64*c* are provided outside of the data signal line drive circuits 6*a*, 6*b*, and 6*c*, respectively.

(Modification 3)

Figure 8:
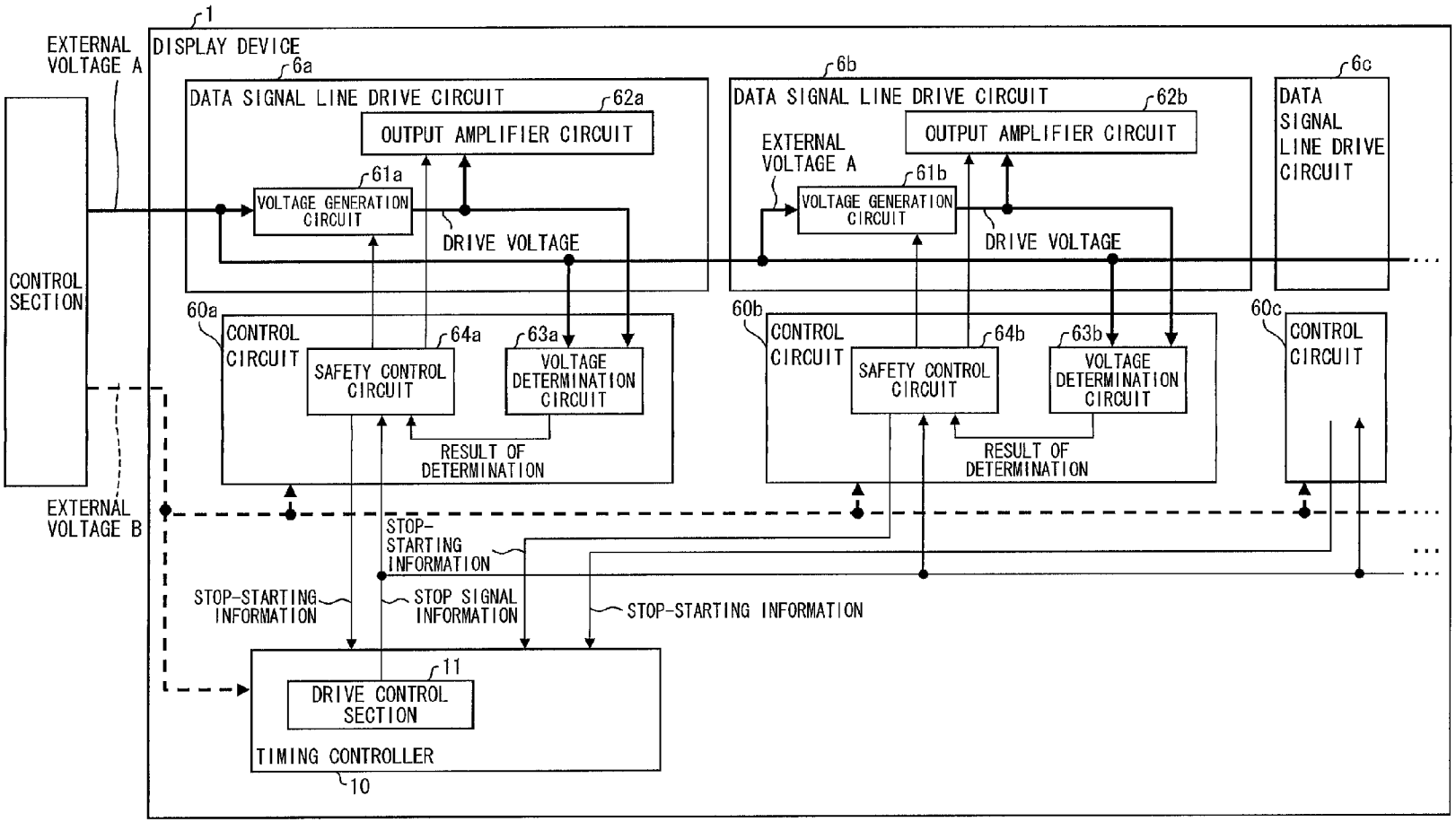
FIG. 8 is a diagram showing a configuration of a display device according to Modification 3 of Embodiment 1.

FIG. 8 is a diagram showing a configuration of a display device 1 according to Modification 3. In the display device 1 of FIG. 1, the control circuits 60*a*, 60*b*, and 60*c* are provided inside of the data signal line drive circuits 6*a*, 6*b*, and 6*c*, respectively. In the display device 1 according to Modification 3, as shown in FIG. 8, the control circuits 60*a*, 60*b*, and 60*c* are provided outside of the data signal line drive circuits 6*a*, 6*b*, and 6*c*, respectively. This makes it possible to reduce the data signal line drive circuits 6*a*, 6*b*, and 6*c* in size.

(Modification 4)

Figure 9:
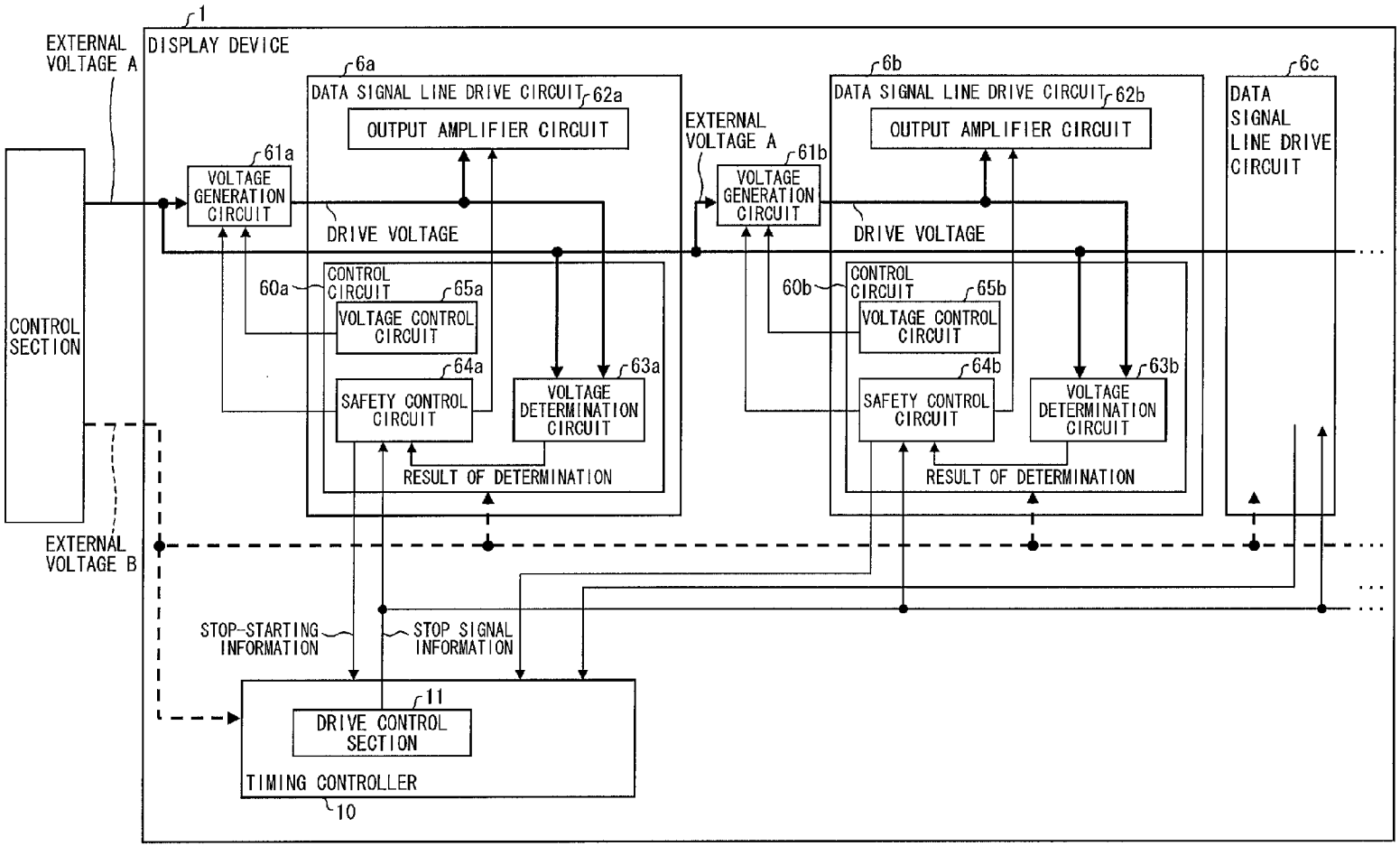
FIG. 9 is a diagram showing a configuration of a display device according to Modification 4 of Embodiment 1.

FIG. 9 is a diagram showing a configuration of a display device 1 according to Modification 4. In the display device 1 of FIG. 1, the voltage generation circuits 61*a*, 61*b*, and 61*c* are provided inside of the data signal line drive circuits 6*a*, 6*b*, and 6*c*, respectively. In the display device 1 according to Modification 4, as shown in FIG. 9, the voltage generation circuits 61*a*, 61*b*, and 61*c* are provided outside of the data signal line drive circuits 6*a*, 6*b*, and 6*c*, respectively. It should be noted that in the display device 1 according to Modification 4, the control circuits 60*a*, 60*b*, and 60*c* are provided with voltage control circuits 65*a*, 65*b*, and 65*c* that control the voltage generation circuits 61*a*, 61*b*, and 61*c*, respectively.

This configuration makes it possible to reduce the data signal line drive circuits 6*a*, 6*b*, and 6*c* in size. It should be noted that the voltage generation circuits 61*a*, 61*b*, and 61*c* may be provided outside of the display device 1, e.g., on a substrate on which the control section (FIG. 9) is mounted.

(Modification 5)

Figure 10:
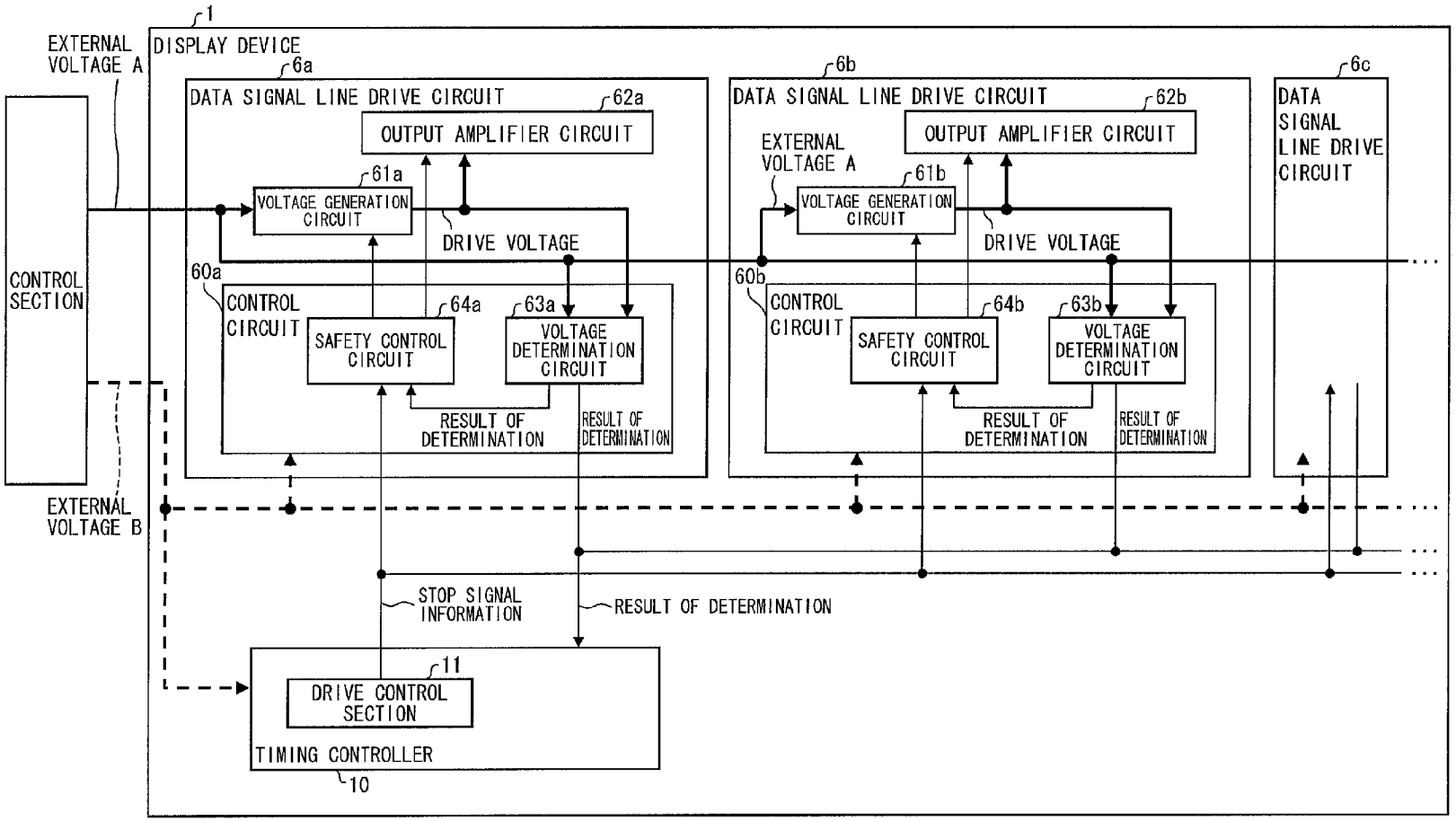
FIG. 10 is a diagram showing a configuration of a display device according to Modification 5 of Embodiment 1.
Figure 11:
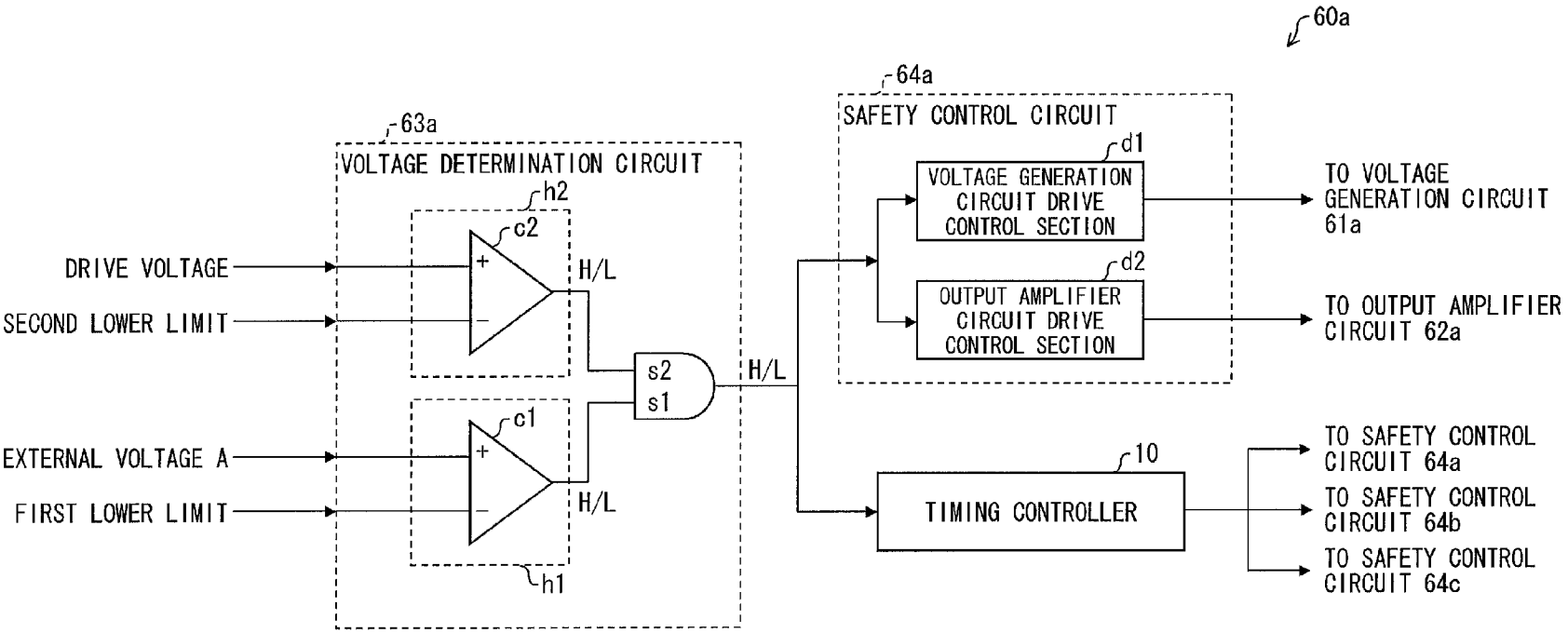
FIG. 11 is a diagram specifically showing a configuration of a control circuit in the display device according to Modification 5.

FIG. 10 is a diagram showing a configuration of a display device 1 according to Modification 5 In the display device 1 of FIG. 1, the timing controller 10 is configured to output stop signal information upon receiving stop-starting information from the safety control circuits 64*a*, 64*b*, and 64*c*. In the display device 1 according to Modification 5, as shown in FIG. 10, the timing controller 10 is configured to receive results of determination (H level ("1"), L level ("0")) from the voltage determination circuits 63*a*, 63*b*, and 63*c* and transmit stop signal information to the safety control circuits 64*a*, 64*b*, and 64*c* in accordance with the results of determination thus received. That is, as shown in FIG. 11, the voltage determination circuit 63*a* outputs a result of determination to the safety control circuit 64*a* and to the timing controller 10. In FIG. 10, the safety control circuits 64*a*, 64*b*, and 64*c* share a common signal line with one another as in the case of Modification 1. The configuration of the display device 1 according to Modification 5 can bring about the same effects as those which are brought about by the configuration shown in FIG. 1.

(Configuration of a Voltage Generation Circuit)

Figure 12:
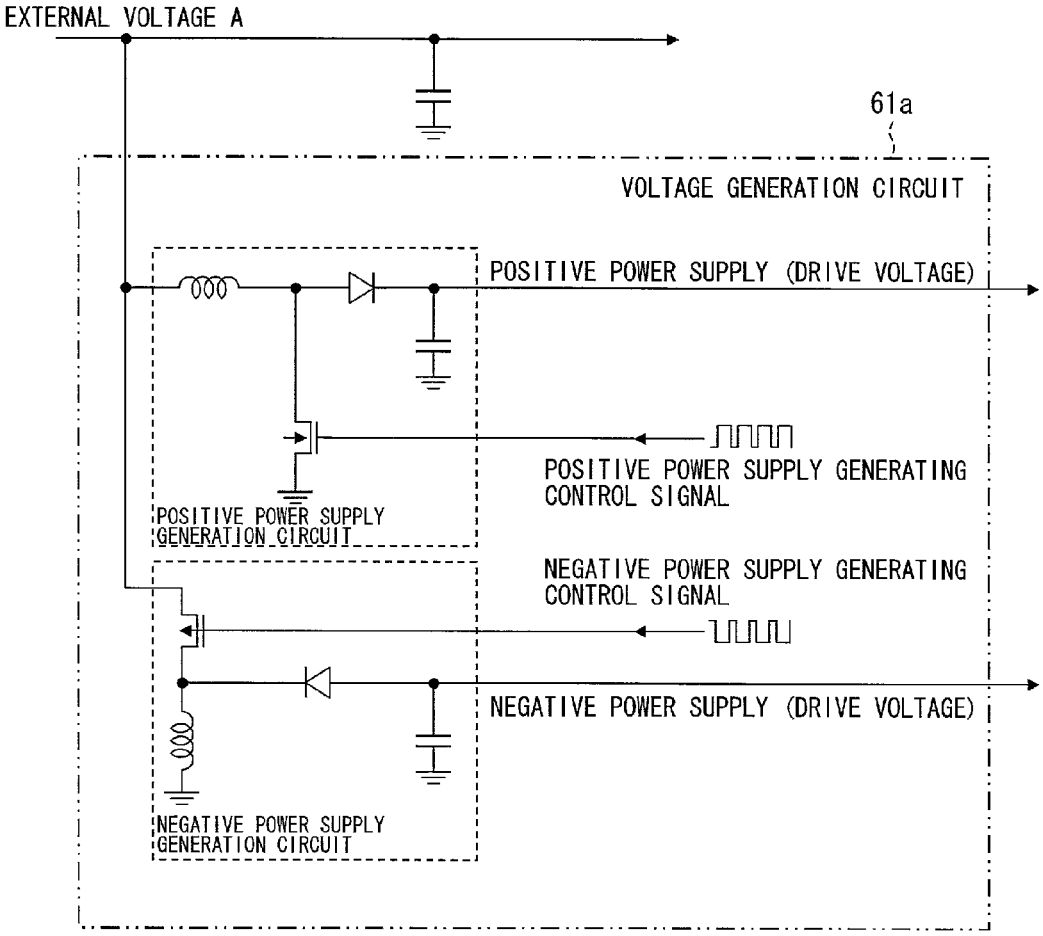
FIG. 12 is a diagram specifically showing a configuration of a voltage generation circuit in the display device according to Embodiment 1.

FIG. 12 is a diagram specifically showing a configuration of a voltage generation circuit in the display device 1. In FIG. 12, an example configuration in which positive and negative power supplies (drive voltages) are generated is described by taking the voltage generation circuit 61*a* of the data signal line drive circuit 6*a* as an example. As shown in FIG. 12, a positive voltage is generated by a so-called step-up DCDC circuit, and a negative voltage is generated by a so-called step-down DCDC circuit. The configuration of FIG. 12 makes it possible to adjust generative capacity and take measures against EMI (radio disturbance) separately by adjusting the duty ratio and frequency of a positive power supply generating control signal that is inputted to the step-up DCDC circuit and the duty ratio and frequency of a negative power supply generating control signal that is inputted to the step-down DCDC circuit separately.

It should be noted that in the display device 1 according to Modification 4 as shown in FIG. 9, such positive power supply generating control signals, such negative power supply generating control signals, etc. are outputted from the voltage control circuits 65*a*, 65*b*, and 65*c*.

Embodiment 2

A configuration of a display device (liquid crystal display device) 1*a* according to Embodiment 2 of the present invention is described below. It should be noted that the following describes points of difference from the display device 1 according to Embodiment 1, and components having the same functions as those of the components described in Embodiment 1 are given the same reference signs, and as such, are not described below.

Figure 13:
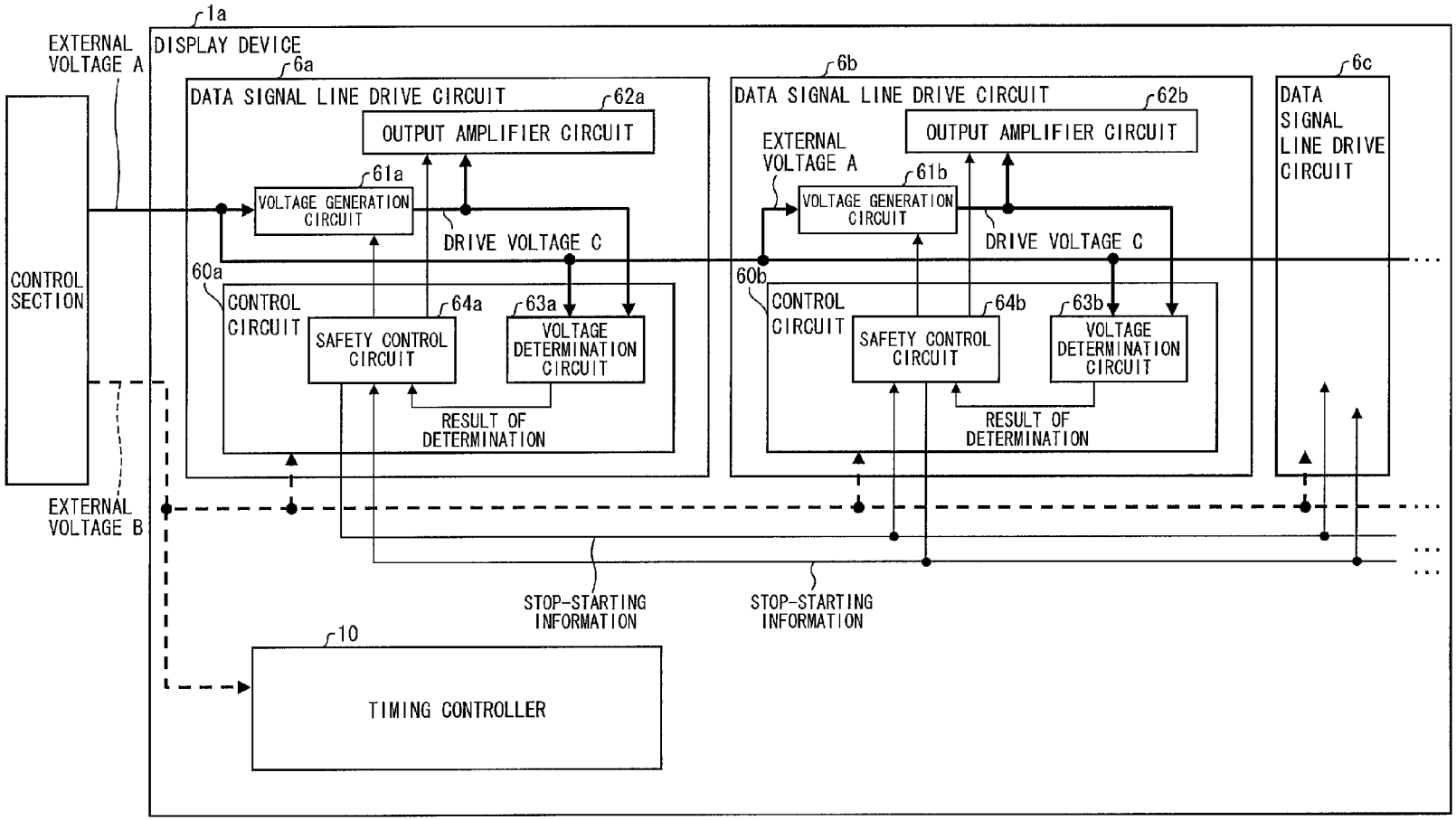
FIG. 13 is a diagram specifically showing a configuration of data signal line drive circuits in a display device according to Embodiment 2.

FIG. 13 is a diagram specifically showing a configuration of a data signal line drive circuit 6 in the display device 1*a*. A configuration of the data signal line drive circuit 6 is described in detail below with reference to FIG. 13.

The data signal line drive circuit 6 includes a plurality of data signal line drive circuits 6*a*, 6*b*, 6*c*, . . . , and each of the data signal line drive circuits 6*a*, 6*b*, 6*c*, . . . are provided for a plurality of data signal lines. In Embodiment 2, too, a case is described where the display device 1 is provided with three data signal line drive circuits 6*a*, 6*b*, and 6*c*. Further, since the data signal line drive circuits 6*a*, 6*b*, and 6*c* are identical in configuration to one another, the case is described by taking the data signal line drive circuit 6*a* as a main example.

The data signal line drive circuit 6*a* includes a voltage generation circuit 61*a*, an output amplifier circuit 62*a*, and a control circuit 60*a*, and the control circuit 60*a* includes a voltage determination circuit 63*a* and a safety control circuit 64*a*.

The voltage generation circuit 61*a* receives an external voltage A inputted from the power supply section (not illustrated) of the external control section and generates, in accordance with the external voltage A, a drive voltage that is necessary for the output amplifier circuit 62*a*. The drive voltage thus generated is inputted to the output amplifier circuit 62*a* and the voltage determination circuit 63*a*.

The output amplifier circuit 62*a* includes a plurality of analog amplifier blocks (not illustrated) each of which is connected to a data signal line S and supplies a data signal to that data signal line S.

The voltage determination circuit 63*a* receives the external voltage A inputted from the power supply section of the external control section and the drive voltage generated in the voltage generation circuit 61*a*. Then, the voltage determination circuit 63*a* performs a process (first determination process) of determining, by comparing the external voltage A with a predetermined first range of allowable voltages, whether or not the external voltage A falls within the first range of allowable voltages. Further, the voltage determination circuit 63*a* performs a process (second determination process) of determining, by comparing the drive voltage with a predetermined second range of allowable voltages, whether or not the drive voltage falls within the second range of allowable voltages. This makes it possible to detect an abnormality in power-supply voltage in the data signal line drive circuit 6*a*. Upon detecting an abnormality in power-supply voltage, i.e., in a case where at least either the external voltage A or the drive voltage no longer falls within its corresponding range of allowable voltage (first range of allowable voltages, second range of allowable voltages), the voltage determination circuit 63*a* transmits a result of determination to that effect to the safety control circuit 64*a*.

The safety control circuit 64*a* performs a process of controlling how the voltage generation circuit 61*a* and the output amplifier circuit 62*a* are driven. Upon receiving the result of determination from the voltage determination circuit 63*a*, the safety control circuit 64*a* outputs, to the voltage generation circuit 61*a* and the output amplifier circuit 62*a*, stop signal information corresponding to a drive-stopping command. Upon receiving the stop signal information, the voltage generation circuit 61*a* stops the operation of generating a drive voltage and the operation of outputting the drive voltage thus generated. Upon receiving the stop signal information, the output amplifier circuit 62*a* stops the operation of outputting a data signal to a data signal line S.

Further, upon receiving the result of determination from the voltage determination circuit 63*a*, the safety control circuit 64*a* further transmits, to the safety control circuits 64*b* and 64*c* of the data signal line drive circuits 6*b* and 6*c*, stop-starting information for starting a stopping process of stopping the operation of the voltage generation circuits 61*b* and 61*c* and the output amplifier circuits 62*b* and 62*c*.

Upon receiving the stop signal information from the safety control circuit 64*a* of the data signal line drive circuit 6*a*, the safety control circuit 64*b* of the data signal line drive circuit 6*b* outputs the stop signal information to the voltage generation circuit 61*b* and to the output amplifier circuit 62*b*. Upon receiving the stop signal information, the voltage generation circuit 61*b* stops the operation of generating a drive voltage and the operation of outputting the drive voltage thus generated. Upon receiving the stop signal information, the output amplifier circuit 62*b* stops the operation of outputting a data signal to a data signal line S.

Similarly, upon receiving the stop signal information from the safety control circuit 64*a* of the data signal line drive circuit 6*a*, the safety control circuit 64*c* of the data signal line drive circuit 6*c* outputs the stop signal information to the voltage generation circuit 61*c* and to the output amplifier circuit 62*c*. Upon receiving the stop signal information, the voltage generation circuit 61*c* stops the operation of generating a drive voltage and the operation of outputting the drive voltage thus generated. Upon receiving the stop signal information, the output amplifier circuit 62*c* stops the operation of outputting a data signal to a data signal line S.

With this configuration, the operation of the voltage generation circuits and the output amplifier circuits in all of the data signal line drive circuits is stopped in the case of an abnormality (voltage reduction or voltage rise) in either the external voltage A or the drive voltage in a data signal line drive circuit. This prevents the external voltage A from continuing to be supplied to a normal data signal line drive circuit and the drive voltage from continuing to be generated as has conventionally been the case, thereby preventing problems such as heating and fuming.

Further, the configuration of Embodiment 2, in which the operation of the voltage generation circuits and the output amplifier circuits in all of the data signal line drive circuits is stopped without using the timing controller 10, makes it possible to simplify the circuit configuration of the display device 1*a*.

It should be noted here that the display device 1*a* may be configured, as shown in Modifications 2 and 3, that the voltage determination circuits 63*a*, 63*b*, and 63*c* and the voltage generation circuits 61*a*, 61*b*, and 61*c* are provided outside of the data signal line drive circuits 6*a*, 6*b*, and 6*c*, respectively.

Further, a specific structure of the control circuit 60*a* is identical to that described in Embodiment 1.

(Modification 6)

Figure 14:
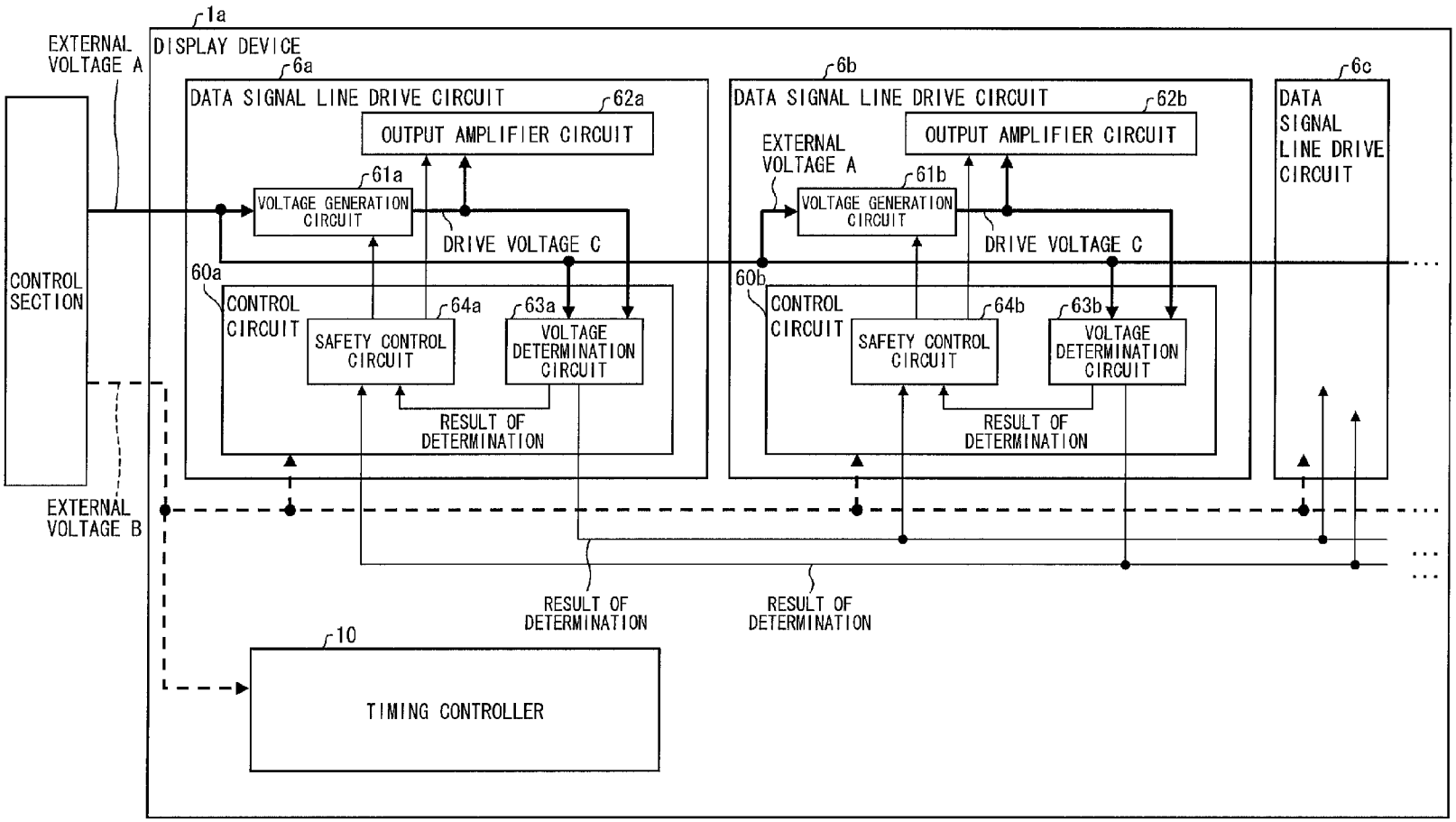
FIG. 14 is a diagram showing a configuration of a display device according to Modification 6 of Embodiment 2.
Figure 15:
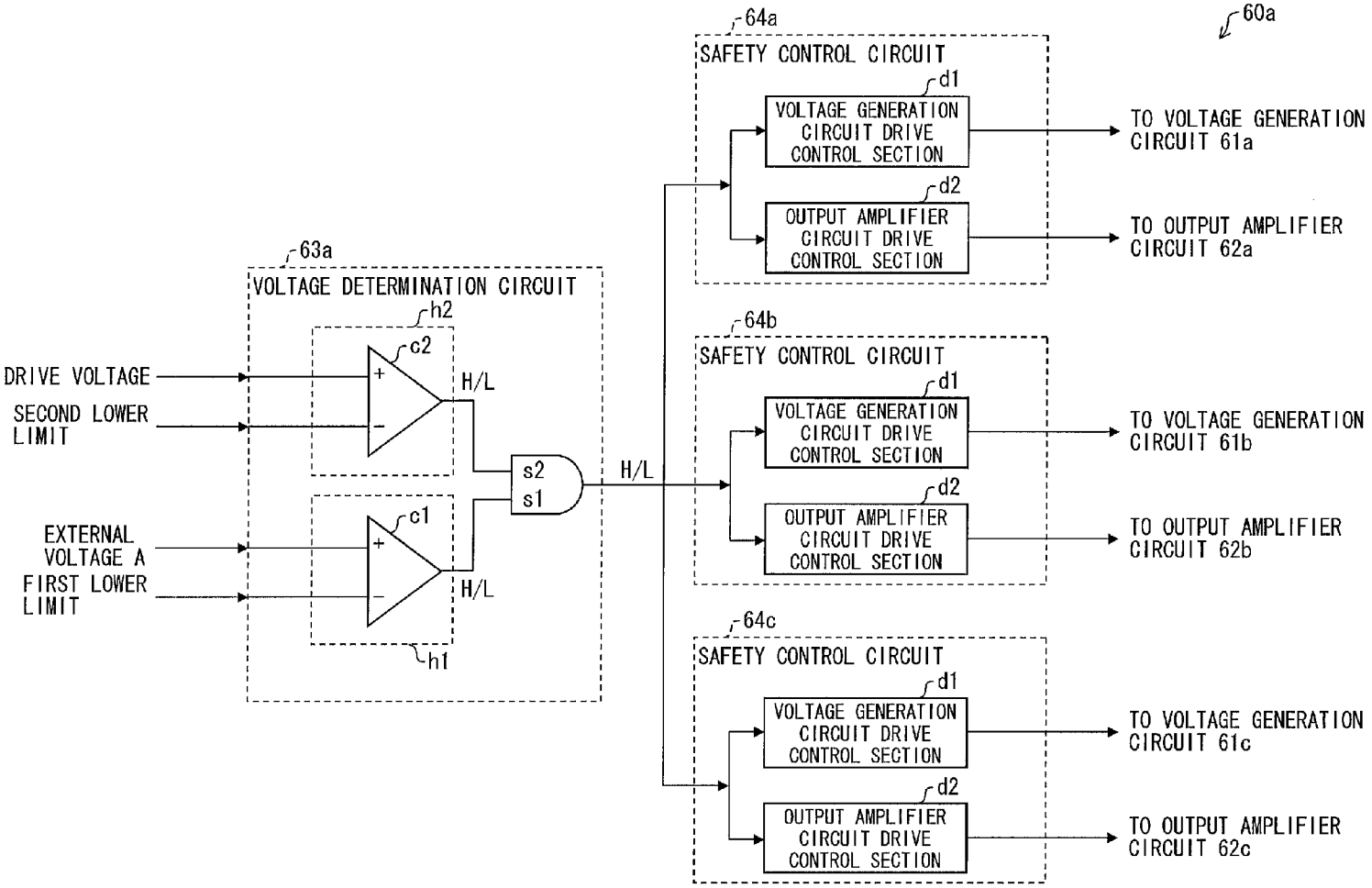
FIG. 15 is a diagram specifically showing a configuration of a control circuit in the display device according to Modification 6.

FIG. 14 is a diagram showing a configuration of a display device 1*a* according to Modification 6. While the display device 1*a* of FIG. 13 is configured such that the safety control circuit 64*a* of the data signal line drive circuit 6*a*, for example, transmits stop-starting information to the safety control circuits 64*b* and 64*c* of the data signal line drive circuits 6*b* and 6*c*, the display device 1*a* according to Modification 6 is configured such that the voltage determination circuit 63*a* of the data signal line drive circuit 6*a* transmits a result of determination to the safety control circuits 64*b* and 64*c* of the data signal line drive circuits 6*b* and 6*c*. That is, as shown in FIG. 15, the voltage determination circuit 63*a* outputs a result of determination to the safety control circuits 64*a*, 64*b*, and 64*c*.

Upon receiving the result of determination, the safety control circuits 64*a*, 64*b*, and 64*c* transmit stop signal information to their corresponding voltage generation circuits 61*a*, 61*b*, and 61*c* and to their corresponding output amplifier circuits 62*a*, 62*b*, and 62*c*, respectively. This causes the operation of the voltage generation circuits 61*a*, 61*b*, and 61*c* and the output amplifier circuits 62*a*, 62*b*, and 62*c* to be stopped.

(Display Panel)

In each of the embodiments described above, the display panel 2 is not limited to a particular configuration.

For example, in a case where the display panel 2 is a liquid crystal display panel, the display device 1 or 1*a* can be configured as a liquid crystal display device.

Alternatively, in a case where the display panel 2 is an EL display panel such as an organic electroluminescent (EL) display panel, the display device 1 or 1*a* can be configured as an electroluminescent display device.

(Transistor)

Figure 16:
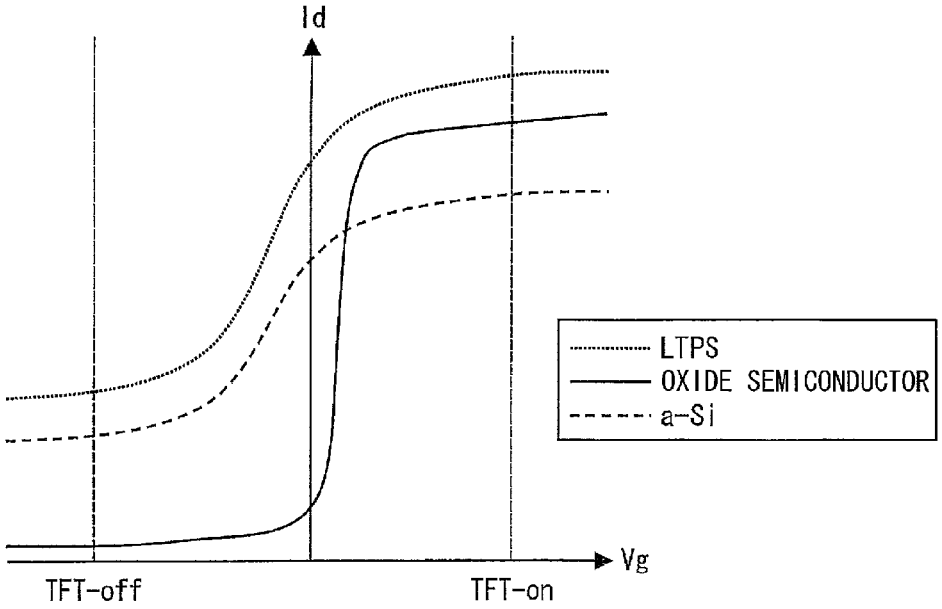
FIG. 16 is a graph showing a characteristic of a TFT made with an oxide semiconductor.
Figure 17:
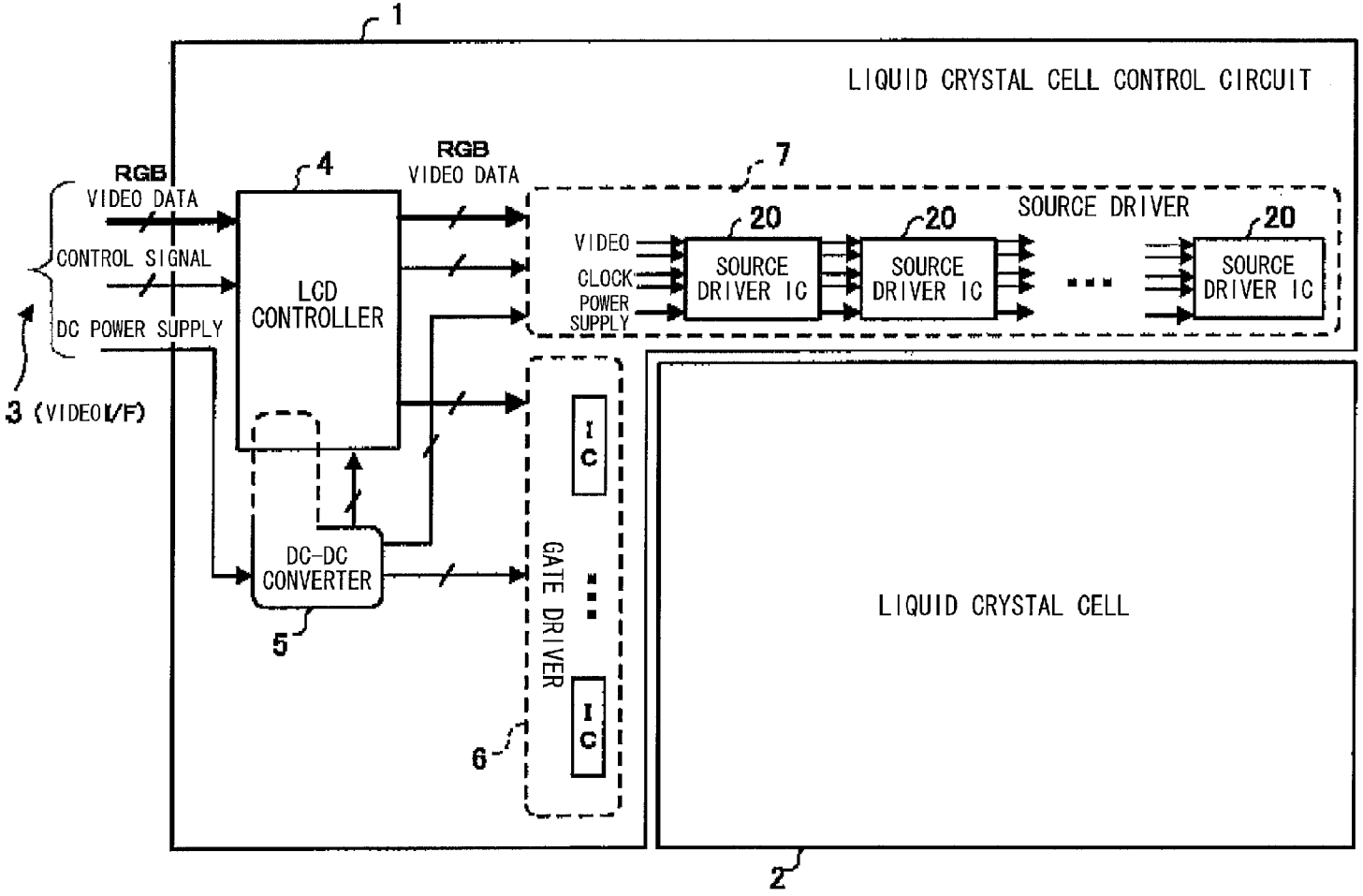
FIG. 17 is a diagram schematically showing a configuration of the liquid crystal display device of Patent Literature 1.
Figure 18:
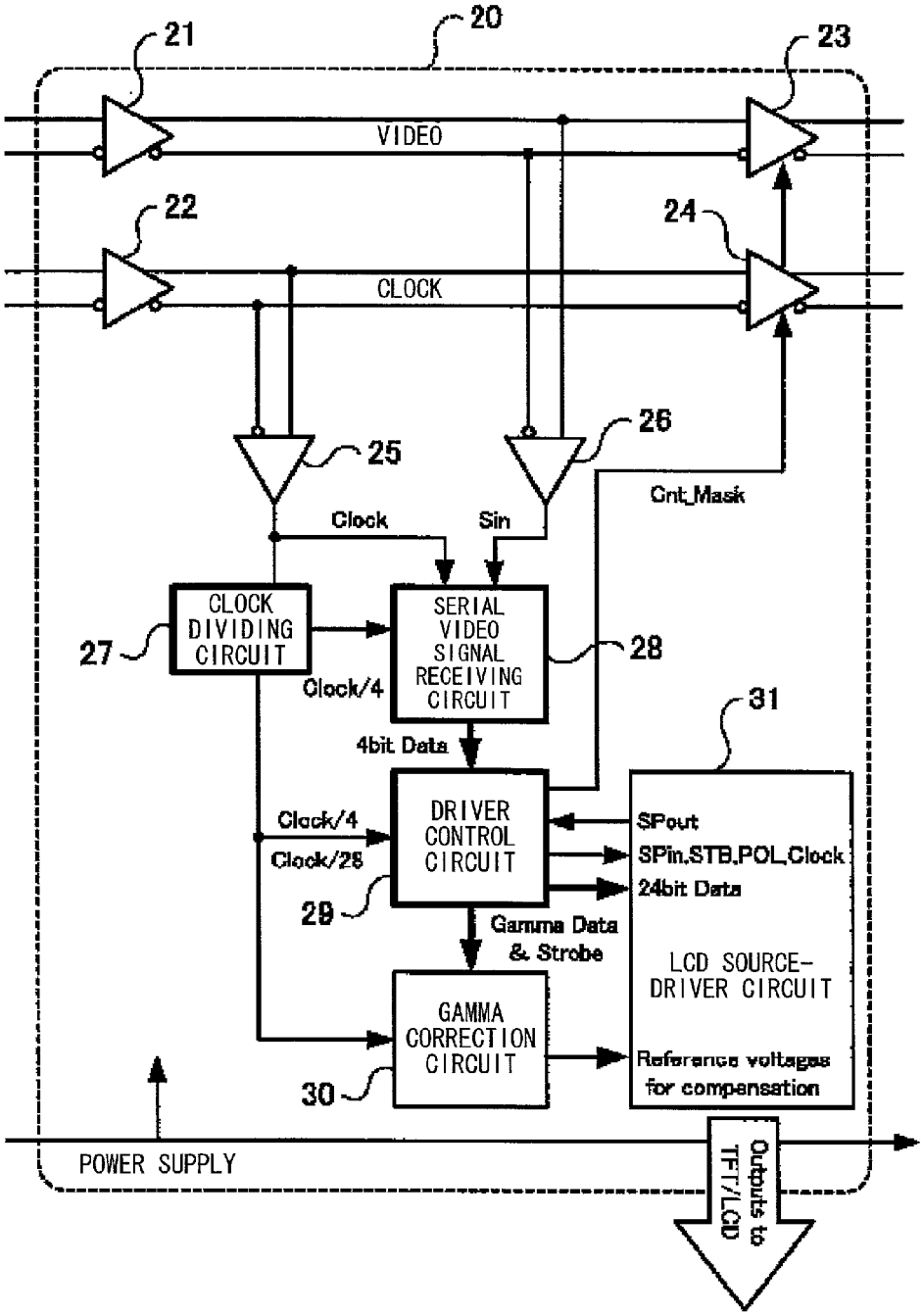
FIG. 18 is a diagram showing an internal configuration of a source driver IC in the liquid crystal display device shown in FIG. 17.

It is desirable, in each of the display devices according to the embodiments described above, that each transistor of the display panel be a TFT having its semiconductor layer made with an oxide semiconductor. Examples of such an oxide semiconductor include IGZO (InGaZnOx). FIG. 16 shows the respective characteristics of a TFT made with an oxide semiconductor, a TFT made with a-Si (amorphous silicon), and a TFT made with LTPS (low-temperature polysilicon). In FIG. 16, the horizontal axis (Vg) represents the value of a gate voltage that is supplied to each TFT, and the vertical axis (Id) represents the value of an electric current between the source and drain of each TFT. Further, in FIG. 16, the period of time "TFT-on" represents a period of time during which the TFT is on, and the period of time "TFT-off" represents a period of time during which the TFT is off.

As shown in FIG. 16, the TFT made with an oxide semiconductor exhibits a higher electric-current value (i.e., electron mobility) during an on-state than does the TFT made with a-Si. Specifically, although not illustrated, whereas the TFT made with a-Si exhibits an electric current Id of 1 uA during an on-state ("TFT-on"), the TFT made with an oxide semiconductor exhibits an electric current of approximately 20 to 50 uA during the period of time TFT-on. This shows that the TFT made with an oxide semiconductor exhibits 20 to 50 times as high an electric current value (electron mobility) during an on-state as does the TFT made with a-Si and is therefore superior in on-state characteristic to the TFT made with a-Si.

For the reasons stated above, use of a TFT made with an oxide semiconductor in each pixel as a transistor for the display panel in each of the display devices according to the embodiments described above renders the on-state characteristic of the TFT in each pixel very good. This increases the electron mobility with which pixel data is written to each pixel, thus making it possible to shorten the time it takes for the pixel data to be written.

The display device according the embodiment of the present invention can be configured such that: the voltage determining means determines whether or not a voltage level of at least either the external voltage or the drive voltage falls below a lower-limit voltage level serving as a lower limit of the range of allowable voltages; and in a case where it has been determined, in at least one of the plurality of voltage determining means, that the voltage level falls below the lower-limit voltage level, operation of the voltage generating means corresponding to all of the data signal line drive circuits is stopped.

This makes it possible to safely stop all of the data signal line drive circuits in the case of an abnormal reduction in voltage level of either the external voltage or the drive voltage in a data signal line drive circuit.

The display device according the embodiment of the present invention can be configured such that: the voltage determining means determines whether or not a voltage level of at least either the external voltage or the drive voltage exceeds an upper-limit voltage level serving as an upper limit of the range of allowable voltages; and in a case where it has been determined, in at least one of the plurality of voltage determining means, that the voltage level exceeds the upper-limit voltage level, operation of the voltage generating means corresponding to all of the data signal line drive circuits is stopped.

This makes it possible to safely stop all of the data signal line drive circuits in the case of an abnormal rise in voltage level of either the external voltage or the drive voltage in a data signal line drive circuit.

The display device according the embodiment of the present invention can be configured such that: each of the plurality of data signal line drive circuits further comprises safety control means for controlling how the voltage generating means is driven; and upon receiving, from the voltage determining means, a result of determination indicating that the voltage level does not fall within the range of allowable voltages, the safety control means causes operation of the voltage generating means corresponding to the data signal line drive circuit in which that safety control means is provided to be stopped.

According to the foregoing configuration, the operation of the voltage generating means of a data signal line drive circuit suffering from such an abnormality in voltage is stopped in accordance an instruction given within the data signal line drive circuit. This makes it possible to immediately perform a stopping process on a data signal line drive circuit suffering from an abnormality.

The display device according the embodiment of the present invention can be configured to further include a timing controller that outputs a control signal for driving each of the plurality of data signal line drive circuits, wherein in accordance with the result of determination, the timing controller 10 outputs, to each of the safety control means of the plurality of data signal line drive circuits, stop signal information for stopping the operation of the voltage generating means.

According to the foregoing configuration, the operation of each of the voltage generating means is stopped in accordance with a stop instruction (stop signal information) from the timing controller that controls each of the data signal line drive circuits. This makes it possible to surely stop all of the voltage generating means.

The display device according the embodiment of the present invention can be configured such that: upon receiving the result of determination from the voltage determining means, the safety control means further transmits, to the timing controller, stop-starting information for starting a stopping process of stopping the operation of the voltage generating means corresponding to all of the data signal line drive circuits; and upon receiving the stop-starting information from the safety control means, the timing controller outputs stop signal information for stopping the operation of the voltage generating means corresponding to all of the data signal line drive circuits.

The display device according the embodiment of the present invention can be configured such that whereas that one of the safety control means which has received the result of determination from the voltage determining means causes the operation of the voltage generating means corresponding to the data signal line drive circuit in which that safety control means is provided to be stopped, that one of the safety control means which has received the stop signal information from the timing controller causes the operation of the voltage generating means corresponding to the data signal line drive circuit in which that safety control means is provided to be stopped.

The display device according the embodiment of the present invention can be configured to further include a timing controller that outputs a control signal for driving each of the plurality of data signal line drive circuits, wherein upon receiving the result of determination from the voltage determining means, the timing controller outputs, to each of the safety control means of the plurality of data signal line drive circuits, stop signal information for stopping the operation of the voltage generating means; and upon receiving the stop signal information from the timing controller, each of the safety control means of the plurality of data signal line drive circuits causes the operation of the voltage generating means corresponding to the data signal line drive circuit in which that safety control means is provided to be stopped.

The display device according the embodiment of the present invention can be configured such that: in a case where in at least one of the data signal line drive circuits the voltage level does not fall within the range of allowable voltages, the voltage determining means corresponding to that data signal line drive circuit transmits the result of determination to the safety control means of that data signal line drive circuit; and upon receiving the result of determination from the voltage generating means, the safety control means further transmits, to the safety control means of all of the other data signal line drive circuits, stop-starting information for starting a stopping process of stopping the operation of the voltage generating means corresponding to those data signal line drive circuits.

According to the foregoing configuration, the safety control means of a data signal line drive circuit suffering from such an abnormality in voltage transmits stop-starting information to the safety control means of the other data signal line drive circuits. That is, the stopping process is performed without using the timing controller. This makes it possible to simplify the circuit configuration of the display device.

The display device according the embodiment of the present invention can be configured such that upon receiving the stop-starting information from at least one of the safety control means of the plurality of data signal line drive circuits, each of the safety control means of the plurality of data signal line drive circuits causes the operation of the voltage generating means corresponding to the data signal line drive circuit in which that safety control means is provided to be stopped.

The display device according the embodiment of the present invention can be configured such that in a case where in at least one of the data signal line drive circuits the voltage level does not fall within the range of allowable voltages, the voltage determining means corresponding to that data signal line drive circuit transmits the result of determination to the safety control means of that data signal line drive circuit and to the safety control means of all of the other data signal line drive circuits.

The display device can be configured such that at least either the voltage determining means or the voltage generating means are provided inside or outside of the data signal line drive circuits.

The display device according the embodiment of the present invention can be configured such that: each of the plurality of data signal line drive circuits includes an amplifier circuit which receives the drive voltage and which supplies a data signal to its corresponding data signal line; and in case where the voltage level does not fall within the range of allowable voltages, operation of the amplifier circuits in all of the data signal line drive circuits is further stopped.

According to the foregoing configuration, the operation of the amplifier circuits as well as the voltage generation circuits is stopped in the case of such an abnormality in voltage. This makes it possible to prevent a failure or the like in an internal circuit of a data signal line drive circuit.

The display device according the embodiment of the present invention can be configured such that the range of allowable voltages is set separately for the external voltage and the drive voltage.

This makes it possible to appropriately determine (detect) an abnormality in voltage even in a case where the external voltage and the drive voltage are different.

The display device according the embodiment of the present invention can be configured such that in a case where it has been determined by the voltage determining means that the voltage level of at least either the external voltage or the drive voltage does not continues to be out of the range of allowable voltages for a predetermined period of time, the operation of the voltage generating means corresponding to all of the data signal line drive circuits is stopped.

The foregoing configuration makes it possible to perform an operation-stopping process in a case where an abnormality in voltage continues for a predetermined period of time, and to avoid performing an operation-stopping process in an essentially normal case, thus making it possible to enhance reliability.

The display device according the embodiment of the present invention is preferably configured to further include a display panel including data signal lines, scan signal lines, pixel electrodes, and transistors each connected to its corresponding one of the data signal lines, its corresponding one of the scan signal lines, and its corresponding one of the pixel electrodes, wherein each of the transistors has its semiconductor layer made with an oxide semiconductor.

The display device according the embodiment of the present invention is preferably configured such that the oxide semiconductor is IGZO.

The display device according the embodiment of the present invention can be a liquid crystal display device including a liquid crystal display panel or an organic EL display device including an organic electroluminescent display panel.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A display device of the present invention is applicable to a display device including a plurality of data signal line drive circuits and to a method for driving such a display device.

REFERENCE SIGNS LIST

1, 1*a* Display device
2 Display panel
4 Scan signal line drive circuit
6*a*, 6*b*, 6*c* Data signal line drive circuit
60*a*, 60*b* Control circuit
61*a*, 61*b* Voltage generation circuit (voltage generating means)
62*a*, 62*b* Output amplifier circuit (amplifier circuit)
63*a*, 63*b* Voltage determination circuit (voltage determining means)
64*a*, 64*b* Safety control circuit (safety control means)
65*a*, 65*b* Voltage control circuit
8 Common electrode drive circuit
10 Timing controller
11 Drive control section
S Data signal line
G Scan signal line
c1 First comparison circuit (voltage determining means)
c2 Second comparison circuit (voltage determining means)
h1 First determination circuit (voltage determining means)
h2 Second determination circuit (voltage determining means)

The invention claimed is:

1. A display device including a plurality of data signal line drive circuits, comprising:

voltage generating circuits, provided for each of the plurality of data signal line drive circuits, that generate, in accordance with an external voltage inputted from an outside source, drive voltages that are needed to drive the data signal line drive circuit; and voltage determining circuits, provided for each of the plurality of data signal line drive circuits, that determine whether or not a voltage level of at least either the external voltage or the drive voltages fall within a predetermined range of allowable voltages, wherein in a case where it has been determined, in at least one of the plurality of voltage determining circuits, that the voltage level does not fall within the range of allowable voltages, operation of the voltage generating circuits corresponding to all of the data signal line drive circuits is stopped such that none of the voltage generating circuits generate the drive voltages, wherein:

each of the plurality of data signal line drive circuits further comprises safety control circuits that control how the voltage generating circuits are driven; and upon receiving, from the voltage determining circuits, a result of determination indicating that the voltage level does not fall within the range of allowable voltages, the safety control circuits cause operation of the voltage generating circuit corresponding to the data signal line drive circuit in which that safety control circuit is provided to be stopped, further comprising a timing controller that outputs a control signal for driving each of the plurality of data signal line drive circuits, wherein upon receiving the result of determination from the voltage determining circuits, the timing controller outputs, to each of the safety control circuits of the plurality of data signal line drive circuits, stop signal information for stopping the operation of the voltage generating circuits; and upon receiving the stop signal information from the timing controller, each of the safety control circuits of the plurality of data signal line drive circuits causes the operation of the voltage generating circuit corresponding to the data signal line drive circuit in which that safety control circuit is provided to be stopped.

2. The display device as set forth in claim 1, wherein:

the voltage determining circuits determine whether or not a voltage level of at least either the external voltage or the drive voltages fall below a lower-limit voltage level serving as a lower limit of the range of allowable voltages; and in a case where it has been determined, in at least one of the plurality of voltage determining circuits, that the voltage level falls below the lower-limit voltage level, operation of the voltage generating circuits corresponding to all of the data signal line drive circuits is stopped.

3. The display device as set forth in claim 1, wherein:

the voltage determining circuits determine whether or not a voltage level of at least either the external voltage or the drive voltage exceeds an upper-limit voltage level serving as an upper limit of the range of allowable voltages; and in a case where it has been determined, in at least one of the plurality of voltage determining circuits, that the voltage level exceeds the upper-limit voltage level, operation of the voltage generating circuits corresponding to all of the data signal line drive circuits is stopped.

4. The display device as set forth in claim 1, further comprising a timing controller that outputs a control signal for driving each of the plurality of data signal line drive circuits, wherein in accordance with the result of determination, the timing controller outputs, to each of the safety control circuits of the plurality of data signal line drive circuits, stop signal information for stopping the operation of the voltage generating circuits.

5. The display device as set forth in claim 4, wherein:

upon receiving the result of determination from the voltage determining circuits, the safety control circuits further transmit, to the timing controller, stop-starting information for starting a stopping process of stopping the operation of the voltage generating circuits corresponding to all of the data signal line drive circuits; and upon receiving the stop-starting information from the safety control circuits, the timing controller outputs stop signal information for stopping the operation of the voltage generating circuits corresponding to all of the data signal line drive circuits.

6. The display device as set forth in claim 4, wherein whereas that one of the safety control circuits which has received the result of determination from the voltage determining circuits causes the operation of the voltage generating circuit corresponding to the data signal line drive circuit in which that safety control circuit is provided to be stopped, that one of the safety control circuits which has received the stop signal information from the timing controller causes the operation of one of the voltage generating circuits corresponding to the data signal line drive circuit in which that safety control circuit is provided to be stopped.

7. The display device as set forth in claim 1, wherein upon receiving the stop-starting information from at least one of the safety control circuits of the plurality of data signal line drive circuits, each of the safety control circuits of the plurality of data signal line drive circuits causes the operation of the voltage generating circuits corresponding to the data signal line drive circuit in which that safety control circuits are provided to be stopped.

8. The display device as set forth in claim 1, wherein at least either the voltage determining circuits or the voltage generating circuits are provided inside or outside of the data signal line drive circuits.

9. The display device as set forth in claim 1, wherein:

each of the plurality of data signal line drive circuits includes an amplifier circuit which receives the drive voltage and which supplies a data signal to its corresponding data signal line; and in case where the voltage level does not fall within the range of allowable voltages, operation of the amplifier circuits in all of the data signal line drive circuits is further stopped.

10. The display device as set forth in claim 1 wherein the range of allowable voltages is set separately for the external voltage and the drive voltage.

11. The display device as set forth in claim 1 wherein in a case where it has been determined by the voltage determining circuits that the voltage level of at least either the external voltage or the drive voltage continues to be out of the range of allowable voltages for a predetermined period of time, the operation of the voltage generating circuits corresponding to all of the data signal line drive circuits continues to be stopped.

12. The display device as set forth in claim 1, further comprising a display panel including data signal lines, scan signal lines, pixel electrodes, and transistors each connected to its corresponding one of the data signal lines, its corresponding one of the scan signal lines, and its corresponding one of the pixel electrodes, wherein each of the transistors has its semiconductor layer made with an oxide semiconductor.

13. The display device as set forth in claim 12, wherein the oxide semiconductor is IGZO.

14. The display device as set forth in claim 1, further comprising a display panel, wherein the display panel is a liquid crystal display panel.

15. The display device as set forth in claim 1, further comprising a display panel, wherein the display panel is an organic electroluminescent display panel.

16. A display device including a plurality of data signal line drive circuits, comprising:

voltage generating circuits, provided for each of the plurality of data signal line drive circuits, that generate, in accordance with an external voltage inputted from an outside source, drive voltages that are needed to drive the data signal line drive circuit; and voltage determining circuits, provided for each of the plurality of data signal line drive circuits, that determine whether or not a voltage level of at least either the external voltage or the drive voltages fall within a predetermined range of allowable voltages, wherein in a case where it has been determined, in at least one of the plurality of voltage determining circuits, that the voltage level does not fall within the range of allowable voltages, operation of the voltage generating circuits corresponding to all of the data signal line drive circuits is stopped such that none of the voltage generating circuits generate the drive voltages, wherein:

each of the plurality of data signal line drive circuits further comprises safety control circuits that control how the voltage generating circuits are driven; and upon receiving, from the voltage determining circuits, a result of determination indicating that the voltage level does not fall within the range of allowable voltages, the safety control circuits cause operation of the voltage generating circuit corresponding to the data signal line drive circuit in which that safety control circuit is provided to be stopped, wherein:

in a case where in at least one of the data signal line drive circuits the voltage level does not fall within the range of allowable voltages, the voltage determining circuits corresponding to that data signal line drive circuit transmits the result of determination to the safety control circuits of that data signal line drive circuit; and upon receiving the result of determination from the voltage generating circuits, the safety control circuits further transmit, to the safety control circuits of all of the other data signal line drive circuits, stop-starting information for starting a stopping process of stopping the operation of the voltage generating circuits corresponding to those data signal line drive circuits.

17. A display device including a plurality of data signal line drive circuits, comprising:

voltage generating circuits, provided for each of the plurality of data signal line drive circuits, that generate, in accordance with an external voltage inputted from an outside source, drive voltages that are needed to drive the data signal line drive circuit; and voltage determining circuits, provided for each of the plurality of data signal line drive circuits, that determine whether or not a voltage level of at least either the external voltage or the drive voltages fall within a predetermined range of allowable voltages, wherein in a case where it has been determined, in at least one of the plurality of voltage determining circuits, that the voltage level does not fall within the range of allowable voltages, operation of the voltage generating circuits corresponding to all of the data signal line drive circuits is stopped such that none of the voltage generating circuits generate the drive voltages, wherein:

each of the plurality of data signal line drive circuits further comprises safety control circuits that control how the voltage generating circuits are driven; and upon receiving, from the voltage determining circuits, a result of determination indicating that the voltage level does not fall within the range of allowable voltages, the safety control circuits cause operation of the voltage generating circuit corresponding to the data signal line drive circuit in which that safety control circuit is provided to be stopped, wherein in a case where in at least one of the data signal line drive circuits the voltage level does not fall within the range of allowable voltages, the voltage determining circuit corresponding to that data signal line drive circuit transmits the result of determination to the safety control circuit of that data signal line drive circuit and to the safety control circuits of all of the other data signal line drive circuits.

* * * * *